US006109368A

United States Patent [19]

Goldman et al.

[11] Patent Number: 6,109,368

[45] Date of Patent: Aug. 29, 2000

[54] METHOD AND SYSTEM FOR PREDICTING PERFORMANCE OF A DRILLING SYSTEM FOR A GIVEN FORMATION

[75] Inventors: William A. Goldman; Lee Morgan Smith, both of Houston; Oliver Mathews, III, Spring; Kambiz Arab, Houston; William W. King, Houston; Kelley M. Murrell, Houston; Gary E. Weaver, Conroe, all of Tex.

[73] Assignee: Dresser Industries, Inc., Dallas, Tex.

[21] Appl. No.: 09/192,389

[22] Filed: Nov. 13, 1998

Related U.S. Application Data

[63] Continuation-in-part of application No. 09/048,360, Mar. 26, 1998, which is a continuation-in-part of application No. 08/621,411, Mar. 25, 1996, Pat. No. 5,794,720.

[51] Int. Cl.[7] ..... E21B 47/00; E21B 44/00

[52] U.S. Cl. ..... 175/39; 175/40; 175/57; 702/9

[58] Field of Search ..... 175/39, 40, 57, 175/24; 702/9

[56] References Cited

U.S. PATENT DOCUMENTS

| | | | |
|---|---|---|---|
| 3,593,807 | 7/1971 | Klima | 173/6 |
| 3,752,966 | 8/1973 | Foy, Jr. et al. | 175/40 X |
| 3,971,449 | 7/1976 | Nylund et al. | 175/27 |
| 4,064,749 | 12/1977 | Pittman et al. | 73/152 |
| 4,195,699 | 4/1980 | Rogers et al. | 175/27 |
| 4,354,233 | 10/1982 | Zhukovsky et al. | 175/27 X |
| 4,407,017 | 9/1983 | Zhilikov et al. | 702/9 |
| 4,627,276 | 12/1986 | Burgess et al. | 73/151 |
| 4,685,329 | 8/1987 | Burgess | 73/151 |
| 4,694,686 | 9/1987 | Fildes et al. | 73/104 |
| 4,793,421 | 12/1988 | Jasinski | 175/27 |
| 4,845,628 | 7/1989 | Gray et al. | 73/152.44 |
| 4,875,530 | 10/1989 | Frink et al. | 175/27 |
| 4,914,591 | 4/1990 | Warren et al. | 364/422 |
| 4,926,686 | 5/1990 | Fay | 175/39 X |
| 4,981,037 | 1/1991 | Holbrook et al. | 175/50 X |

(List continued on next page.)

FOREIGN PATENT DOCUMENTS

| | | | |
|---|---|---|---|
| 0 466 255 A2 | 1/1992 | European Pat. Off. . | |
| 470593 | 8/1975 | Russian Federation | 175/27 |
| 726295 | 4/1980 | Russian Federation | 175/27 |
| 1716112 | 2/1992 | Russian Federation | 175/24 |

OTHER PUBLICATIONS

E.M. Galle and H.B Woods, "Best Constant Weight And Rotary Speed For Rotary Rock Bits", pp. 48–73, API Drilling and Production Practice, 1963.

(List continued on next page.)

*Primary Examiner*—Hoang Dang
*Attorney, Agent, or Firm*—Haynes and Boone, LLP; Michael J. Balconi-Lamica

[57] ABSTRACT

A method and apparatus for predicting the performance of a drilling system for the drilling of a well bore in a given formation includes generating a geology characteristic of the formation per unit depth according to a prescribed geology model, obtaining specifications of proposed drilling equipment for use in the drilling of the well bore, and predicting a drilling mechanics in response to the specifications as a function of the geology characteristic per unit depth according to a prescribed drilling mechanics model. The geology characteristic includes at least rock strength. The specifications includes at least a bit specification of a recommended drill bit. Lastly, the predicted drilling mechanics include at least one of bit wear, mechanical efficiency, power, and operating parameters. A display is provided for generating a display of the geology characteristic and predicted drilling mechanics per unit depth, including either a display monitor or a printer.

102 Claims, 7 Drawing Sheets

U.S. PATENT DOCUMENTS

| | | | |
|---|---|---|---|
| 5,010,789 | 4/1991 | Brett et al. | 76/108.2 |
| 5,012,674 | 5/1991 | Millheim et al. | 73/818 X |
| 5,216,917 | 6/1993 | Detourney | 73/151 |
| 5,282,384 | 2/1994 | Holbrook | 73/152.05 |
| 5,305,836 | 4/1994 | Holbrook et al. | 175/27 |
| 5,415,030 | 5/1995 | Jogi et al. | 73/151 |
| 5,442,950 | 8/1995 | Umalmiser et al. | 73/152.05 X |
| 5,449,047 | 9/1995 | Shivley, Jr. | 175/27 |
| 5,458,207 | 10/1995 | Mattero | 175/27 |
| 5,704,436 | 1/1998 | Smith et al. | 175/27 |
| 5,767,399 | 6/1998 | Smith et al. | 73/152.11 |
| 5,965,810 | 10/1999 | Holbrook | 73/152.05 |
| 6,021,859 | 2/2000 | Tibbitts et al. | 175/431 |

OTHER PUBLICATIONS

R. Teale, "The Concept Of Specific Energy In Rock Drilling", pp. 57–63, International Journal of Rock Mechanics, Mining Sciences, vol. 2, 1965, Great Britain.

Howell Word and Marvin Fisbeck, "Drilling Parameters And The Journal Bearing Carbide Bit", pp. 92–93, Drilling—DCW, Jan. 1980, first published Oct. 1979 in Tulsa, Oklahoma.

R.C. Pessier, M.J. Fear, "Quantifying Common Drilling Problems With Mechanical Specific Energy And A Bit–Specific Coefficient Of Sliding Friction", pp. 373–388, SPE Paper 24584, published Oct. 1982, Washington, D.C.

Michael A. Simpson, Sr., "Hand–Held Calculator Program Helps Optimize Drilling", pp. 97–101, World Oil, Apr. 1984.

Kenneth L. Mason, "3–Cone Bit Selection With Sonic Logs", pp. 135–142, SPE Drilling Engineering, Jun. 1987, first published Sep. 1984 in Houston, Texas.

Allen D. Gault, "Measurement Of Drilling Properties", pp. 143–148, SPE Drilling Engineer, Jun. 1987, published New Orleans, Louisiana, Mar. 1985.

T.M. Burgess, W.C. Lesso, "Measuring The Wear Of Milled Tooth Bits Using MWD Torque And Weight–On–Bit", SPE/IADC 13475, pp. 453–458 for pages illustration, published Mar. 1985, New Orleans, Louisiana.

Philip Holbrook, Michael Hauck, "Petrophysical—Mechanical Math Model Real–Time Wellsite Poor Pressure/Fracture Gradient Prediction", Society of Petroleum Engineers (STE) Pub. No. 16666, Published Sep. 1987 in Dallas, Texas.

E.C. Onyia, "Relationships Between Formation Strength, Drilling Strength, And Electric Log Properties", pp. 605–618, SPE Drilling Engineering, Oct., 1988.

David A. Glowka, "Use Of Single–Cutter Data In The Analysis Of PDC Bit Designs: Part I—Development Of A PDC Cutting Force Model", pp. 797–849, JPT, Aug. 1989.

D.A. Glowka, "Use Of Single–Cutter Data In The Analysis Of PDC Bit Designs: Part II—Development Of PDCWEAR Computer Code", pp. 850–859, JPT, Aug. 1989.

E. Detournay, P. Defourny, "A Phenomenological Model For The Drilling Action Of Drag Bits", pp. 13–23, International Journal of Rock Mechanics, Mineral Sciences and Geomechanical Abstracts, vol. 29, No. 1, 1992, printed in Great Britain.

Joe Kelly, Jr., "Use Break–Even Analysis To Optimize Bit Runs", pp. 75–79, World Oil, Nov. 1992.

Geir Hareland and L.L. Hoberock, "Use Of Drilling Parameters To Predict In–Situ Stress Bounds", pp. 457–471, SPE/IADC 25727, Feb., 1993.

J.P.R. Sparr and L.W. Ledgerwood, Harvey Goodman, R.L. Graff and T.J. Moo, "Formation Compressive Strength Estimates For Predicting Drillability And PDC Bit Selection", pp. 569–578, SPE/IADC 29397, published Feb. 1995, Amsterdam, Netherlands.

R.V. Barragan, O.L.A. Santos and E.E. Maidla, "Optimization Of Multiple Bit Runs", pp. 579–589, SPE/IADC 37644, Mar. 4, 1997.

R.K. Bratli, G. Hareland, F. Stene, G.W. Dunsaed and G. Gjelstad, "Drilling Optimization Software Verified In The North Sea", 7 pages, SPE 39007, Aug. 1997.

G. Gjelstad, G. Hareland, K.N. Nikolaisen and R.K. Bratli, "The Method Of Reducing Drilling Costs More Than 50 Percent", 7 pages, SPE 47342, Jul., 1998.

M.B. Ziaja and J.C. Roegiers, "Lithology Diagnosis Based On The Measurements Of Drilling Forces And Moments At The Bit", IADC/SPE 47799, pp. 185–194, Sep., 1998.

H. Xu, T. Hatakeyama, T. Yonezawa and A. Suzuki, "Evaluation Of Bit Performance Using An Advanced Drilling–Test System", IADC/SPE 47809, pp. 247–252, Sep., 1998.

H.I. Bilgesu, U. Altmis, S. Ameri, S. Mohaghegh and K. Aminian, "A New Approach To Predict Life Based On Tooth Or Bearing Failures", pp. 253–257, SPE 51082, Nov., 1998.

E.T. Koskie, Jr., P. Slagel and W. Lesso, Jr., "Monitoring MWD Torque Improved PDC Bit Penetration Rates", pp. 61–67, World Oil, 1998.

140

52
160
LITHOLOGY MODEL
146
162
148
150
142
164
ROCK STRENGTH MODEL
SHALE PLASTICITY MODEL
178
166
180
GEOLOGY MODELS
DRILLING MECHANICS MODELS
152
162
162
154
168
MECHANICAL EFFICIENCY MODEL
HOLE CLEANING EFFICIENCY (HCE) MODEL
182
176
166
170
162
172
144
BIT WEAR MODEL
156
184
174
166 162
170
180
186
PENETRATION RATE MODEL
158
188

200

202
DISPLAY OF PREDICTED PERFORMANCE OF DRILLING SYSTEM FOR A GIVEN FORMATION (PLOTS OF DATA VS. DEPTH)
214
GEOLOGY OF FORMATION
Log Data
Depth
Lithology
Porosity
Rock Strength
0 GR(API) 150
2 RHOB(g/cc) 3
140 DT(us/ft) 40
6 CAL(in) 16
MD(ft)
200
SS LS DOL COAL SH
0 ND-POR 0.5
0 N-POR 0.5
0 D-POR 0.5
0 S-POR 0.5
0 CCS(psi) 50000
0 UCS(psi) 50000
0 CORE(psi) 50000
ROCK CCS
450
500
550
600
650
700
222
220
224
280
1350
1400
1450
TO FIG. 4B
208
206
210
212
216
218

200

202
DISPLAY OF PREDICTED PERFORMANCE OF DRILLING SYSTEM FOR A GIVEN FORMATION (PLOTS OF DATA VS. DEPTH)
204
GEOLOGY OF FORMATION
PREDICTED PERFORMANCE OF DRILLING SYSTEM
228
Shale Plasticity
Bit Wear
Mechanical Efficiency
0 PLASTICITY 1
0 CEC-N 1
0 CBW-N 1
0 Vsh-N 1
PLASTICITY
1 ABRASIV(t*mi) 10000
1 WORK(t*mi) 10000
1 SP ENERGY(ksi) 1000
Bit Wear
0 100
234
244
0 TOB-CUT(ft*lb) 4000
0 TOB(ft*lb) 4000
Mech. Effic.
0 100
Mech. Effic. Const.
0 100
250
252
254
242
240
280
FROM FIG. 4A
TO FIG. 4C
230
232
236
238
246
248
256

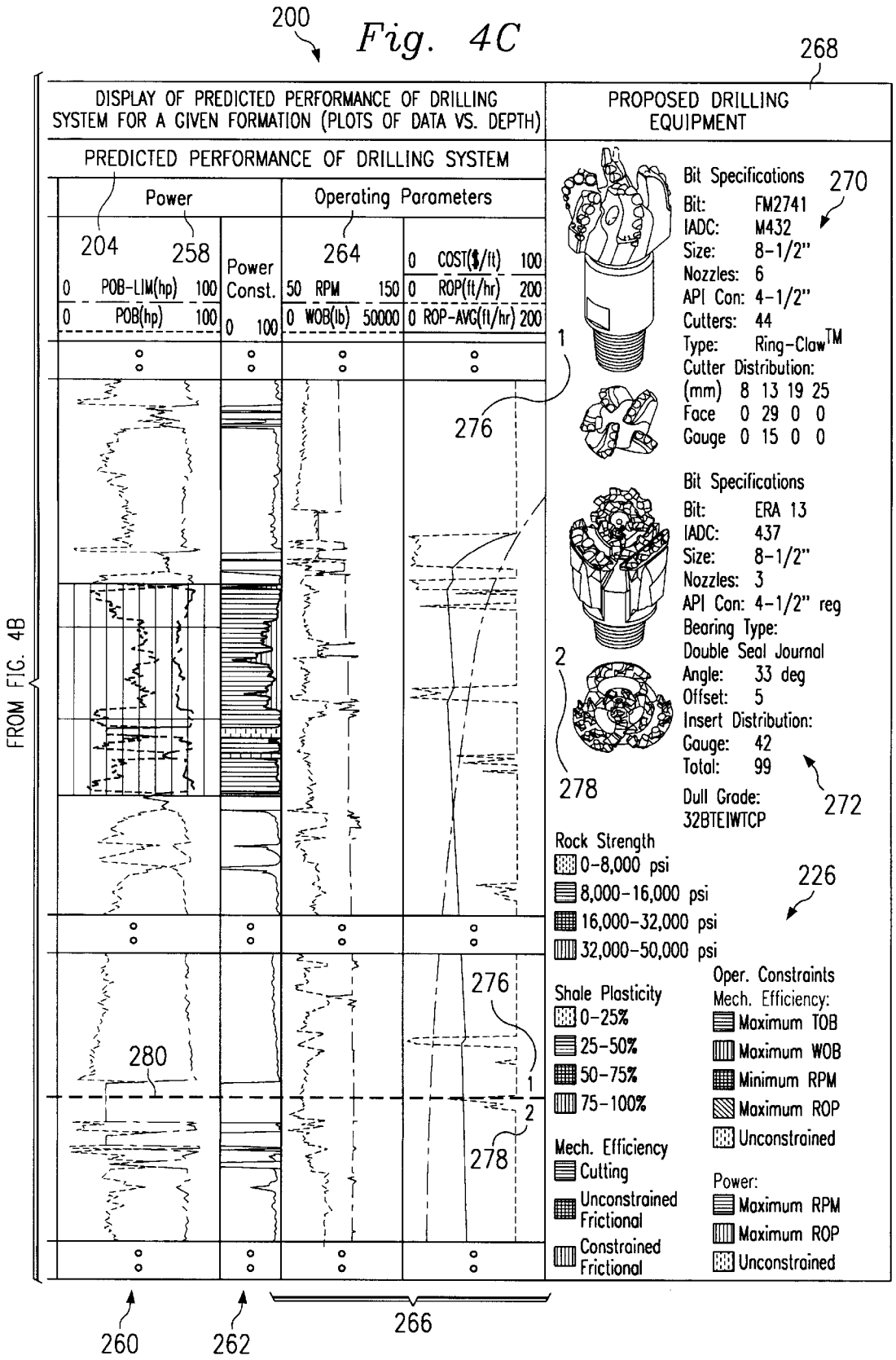
200
Fig. 4C
268
DISPLAY OF PREDICTED PERFORMANCE OF DRILLING SYSTEM FOR A GIVEN FORMATION (PLOTS OF DATA VS. DEPTH)
PROPOSED DRILLING EQUIPMENT
PREDICTED PERFORMANCE OF DRILLING SYSTEM
Power
Operating Parameters
204
258
264
0 POB-LIM(hp) 100
0 POB(hp) 100
Power Const.
0 100
50 RPM 150
0 WOB(lb) 50000
0 COST($/ft) 100
0 ROP(ft/hr) 200
0 ROP-AVG(ft/hr) 200
FROM FIG. 4B
276
280
278
1
2
Bit Specifications
270
Bit: FM2741
IADC: M432
Size: 8-1/2"
Nozzles: 6
API Con: 4-1/2"
Cutters: 44
Type: Ring-Claw™
Cutter Distribution:
(mm) 8 13 19 25
Face 0 29 0 0
Gauge 0 15 0 0
Bit Specifications
Bit: ERA 13
IADC: 437
Size: 8-1/2"
Nozzles: 3
API Con: 4-1/2" reg
Bearing Type:
Double Seal Journal
Angle: 33 deg
Offset: 5
Insert Distribution:
Gauge: 42
Total: 99
Dull Grade:
32BTEIWTCP
272
Rock Strength
0-8,000 psi
8,000-16,000 psi
16,000-32,000 psi
32,000-50,000 psi
226
Shale Plasticity
0-25%
25-50%
50-75%
75-100%
Mech. Efficiency
Cutting
Unconstrained Frictional
Constrained Frictional
Oper. Constraints
Mech. Efficiency:
Maximum TOB
Maximum WOB
Minimum RPM
Maximum ROP
Unconstrained
Power:
Maximum RPM
Maximum ROP
Unconstrained
260
262
266

METHOD AND SYSTEM FOR PREDICTING PERFORMANCE OF A DRILLING SYSTEM FOR A GIVEN FORMATION

CROSS REFERENCE TO CO-PENDING APPLICATION(S)

This application is a continuation-in-part of U.S. patent application Ser. No. 09/048,360, filed on Mar. 26, 1998, which is a continuation-in-part of U.S. patent application Ser. No. 08/621,411, filed on Mar. 25, 1996, now U.S. Pat. No. 5,794,720. The co-pending application and issued patent are incorporated herein by reference in their entirety.

BACKGROUND OF THE INVENTION

1. Field of the Invention

The present invention is related to earth formation drilling operations, and more particularly, to methods and system apparatus for predicting performance of a drilling system for a given formation.

2. Discussion of the Related Art

From the very beginning of the oil and gas well drilling industry, as we know it, one of the biggest challenges has been the fact that it is impossible to actually see what is going on downhole. There are any number of downhole conditions and/or occurrences which can be of great importance in determining how to proceed with the operation. It goes without saying that all methods for attempting to assay such downhole conditions and/or occurrences are indirect. To that extent, they are all less than ideal, and there is a constant effort in the industry to develop simpler and/or more accurate methods.

In general, the approach of the art has been to focus on a particular downhole condition or occurrence and develop a way of assaying that particular condition or occurrence. For example, U.S. Pat. No. 5,305,836, discloses a method whereby the wear of a bit currently in use can be electronically modeled, based on the lithology of the hole being drilled by that bit. This helps a drilling operator determine when it is time to replace the bit.

The process of determining what type of bit to use in a given part of a given formation has, traditionally, been, at best, based only on very broad, general considerations, and at worst, more a matter of art and guess work than of science.

Other examples could be given for other kinds of conditions and/or occurrences.

Furthermore, there are still other conditions and/or occurrences which would be helpful to know. However, because they are less necessary, and in view of the priority of developing better ways of assaying those things which are more important, little or no attention has been given to methods of assaying these other conditions.

SUMMARY OF THE INVENTION

In accordance with one embodiment of the present disclosure, an apparatus for predicting the performance of a drilling system for the drilling of a well bore in a given formation includes a means for generating a geology characteristic of the formation per unit depth according to a prescribed geology model. The geology characteristic generating means is further for outputting signals representative of the geology characteristic, the geology characteristic including at least rock strength. The apparatus further includes a means for inputting specifications of proposed drilling equipment for use in the drilling of the well bore.

The specifications include at least a bit specification of a recommended drill bit. Lastly, the apparatus further includes a means for determining a predicted drilling mechanics in response to the specifications of the proposed drilling equipment as a function of the geology characteristic per unit depth according to a prescribed drilling mechanics model. The predicted drilling mechanics determining means is further for outputting signals representative of the predicted drilling mechanics. The predicted drilling mechanics include at least one of the following selected from the group consisting of bit wear, mechanical efficiency, power, and operating parameters.

In another embodiment, the apparatus further includes a means responsive to the geology characteristic output signals and the predicted drilling mechanics output signals for generating a display of the geology characteristic and predicted drilling mechanics per unit depth. The display generating means includes either a display monitor or a printer. In the instance of the printer, the display of the geology characteristic and predicted drilling mechanics per unit depth includes a printout.

In another embodiment, a method for predicting the performance of a drilling system for the drilling of a well bore in a given formation includes the steps of a) generating a geology characteristic of the formation per unit depth according to a prescribed geology model and outputting signals representative of the geology characteristic, the geology characteristic including at least rock strength; b) obtaining specifications of proposed drilling equipment for use in the drilling of the well bore, the specifications including at least a bit specification of a recommended drill bit; and c) determining a predicted drilling mechanics in response to the specifications of the proposed drilling equipment as a function of the geology characteristic per unit depth according to a prescribed drilling mechanics model and outputting signals representative of the predicted drilling mechanics, the predicted drilling mechanics including at least one of the following selected from the group consisting of bit wear, mechanical efficiency, power, and operating parameters.

In yet another embodiment, a computer program stored on a computer-readable medium for execution by a computer for predicting the performance of a drilling system in the drilling of a well bore of a given formation includes a) instructions for generating a geology characteristic of the formation per unit depth according to a prescribed geology model and outputting signals representative of the geology characteristic, the geology characteristic including at least rock strength; b) instructions for obtaining specifications of proposed drilling equipment for use in the drilling of the well bore, the specifications including at least a bit specification of a recommended drill bit; and c) instructions for determining a predicted drilling mechanics in response to the specifications of the proposed drilling equipment as a function of the geology characteristic per unit depth according to a prescribed drilling mechanics model and outputting signals representative of the predicted drilling mechanics, the predicted drilling mechanics including at least one of the following selected from the group consisting of bit wear, mechanical efficiency, power, and operating parameters.

Still further, in another embodiment, a display of predicted performance of a drilling system suitable for use as guidance in the drilling of a well bore in a given formation is disclosed. The display includes a geology characteristic of the formation per unit depth, the geology characteristic having been obtained according to a prescribed geology model and includes at least rock strength. The display further includes specifications of proposed drilling equipment for use in the drilling of the well bore. The specifications include at least a bit specification of a recommended drill bit. Lastly, the display includes a predicted drilling mechanics, the predicted drilling mechanics having been determined in response to said specifications of the proposed drilling equipment as a function of the geology characteristic per unit depth according to a prescribed drilling mechanics model. The predicted drilling mechanics include at least one of the following selected from the group consisting of bit wear, mechanical efficiency, power, and operating parameters.

Further with respect to the display of the predicted performance, the geology characteristic further includes at least one graphical representation selected from the group consisting of a curve representation, a percentage graph representation, and a band representation, and the display of the predicted drilling mechanics includes at least one graphical representation selected from the group consisting of a curve representation, a percentage graph representation, and a band representation.

The present embodiments advantageously provide for an evaluation of various proposed drilling equipment prior to and during an actual drilling of a well bore in a given formation, further for use with respect to a drilling program. Drilling equipment, its selection and use, can be optimized for a specific interval or intervals of a well bore in a given formation. The drilling mechanics models advantageously take into account the effects of progressive bit wear through changing lithology. Recommended operating parameters reflect the wear condition of the bit in the specific lithology and also takes into account the operating constraints of the particular drilling rig being used. A printout or display of the geology characteristic and predicted drilling mechanics per unit depth for a given formation provides key information which is highly useful for a drilling operator, particularly for use in optimizing the drilling process. The printout or display further advantageously provides a heads up view of expected drilling conditions and recommended operating parameters.

BRIEF DESCRIPTION OF THE DRAWINGS

The foregoing and other teachings and advantages of the present invention will become more apparent upon a detailed description of the best mode for carrying out the invention as rendered below. In the description to follow, reference will be made to the accompanying drawings, in which.

DETAILED DESCRIPTION OF THE PREFERRED EMBODIMENTS

Figure 1:
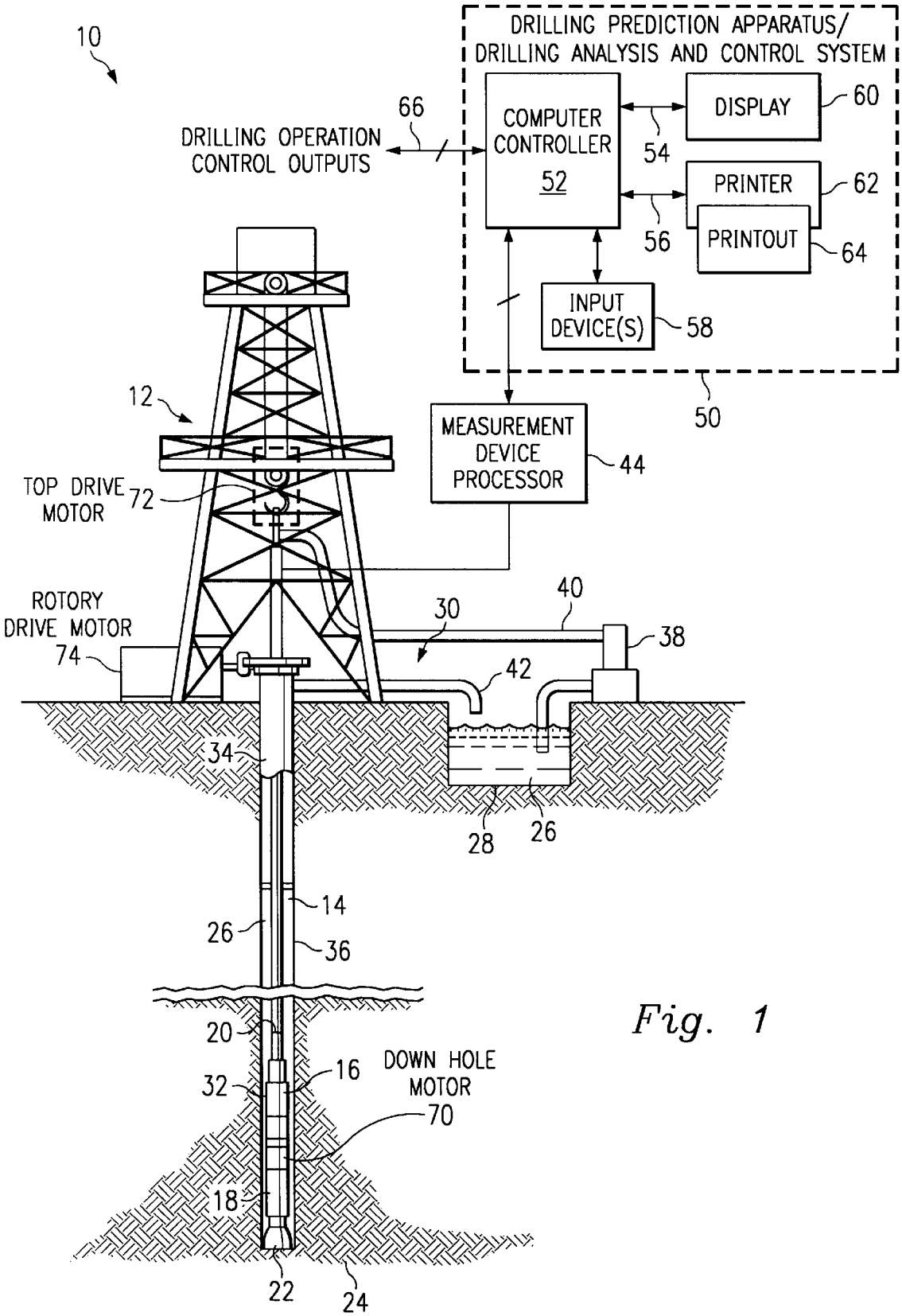
FIG. 1 illustrates a drilling system including an apparatus for predicting the performance of the drilling system for the drilling of a well bore or well bores according to a prescribed drilling program in a given formation.

Referring now to FIG. 1, a drilling system 10 includes a drilling rig 12 disposed atop a borehole 14. A logging tool 16 is carried by a sub 18, typically a drill collar, incorporated into a drill string 20 and disposed within the borehole 14. A drill bit 22 is located at the lower end of the drill string 20 and carves a borehole 14 through the earth formations 24. Drilling mud 26 is pumped from a storage reservoir pit 28 near the wellhead 30, down an axial passageway (not illustrated) through the drill string 20, out of apertures in the bit 22 and back to the surface through the annular region 32. Metal casing 34 is positioned in the borehole 14 above the drill bit 22 for maintaining the integrity of an upper portion of the borehole 14.

With reference still to FIG. 1, the annular 32 between the drill stem 20, sub 18, and the sidewalls 36 of the borehole 14 forms the return flow path for the drilling mud. Mud is pumped from the storage pit near the well head 30 by pumping system 38. The mud travels through a mud supply line 40 which is coupled to a central passageway extending throughout the length of the drill string 20. Drilling mud is, in this manner, forced down the drill string 20 and exits into the borehole through apertures in the drill bit 22 for cooling and lubricating the drill bit and carrying the formation cuttings produced during the drilling operation back to the surface. A fluid exhaust conduit 42 is connected from the annular passageway 32 at the well head for conducting the return mud flow from the borehole 14 to the mud pit 28. The drilling mud is typically handled and treated by various apparatus (not shown) such as out gassing units and circulation tanks for maintaining a preselected mud viscosity and consistency.

The logging tool or instrument 16 can be any conventional logging instrument such as acoustic (sometimes referred to as sonic), neutron, gamma ray, density, photoelectric, nuclear magnetic resonance, or any other conventional logging instrument, or combinations thereof, which can be used to measure lithology or porosity of formations surrounding an earth borehole.

Because the logging instrument is embodied in the drill string 20 in FIG. 1, the system is considered to be a measurement while drilling (MWD) system, i.e., it logs while the drilling process is underway. The logging data can be stored in a conventional downhole recorder (not illustrated), which can be accessed at the earth's surface when the drill sting 20 is retrieved, or can be transmitted to the earth's surface using telemetry such as the conventional mud pulse telemetry systems. In either event, the logging data from the logging instrument 16 eventually reaches a surface measurement device processor 44 to allow the data to be processed for use in accordance with the embodiments of the present disclosure as described herein. That is, processor 44 processes the logging data as appropriate for use with the embodiments of the present disclosure.

In addition to MWD instrumentation, wireline logging instrumentation may also be used. That is, wireline logging instrumentation may also be used for logging the formations surrounding the borehole as a function of depth. With wireline instrumentation, a wireline truck (not shown) is typically situated at the surface of a well bore. A wireline logging instrument is suspended in the borehole by a logging cable which passes over a pulley and a depth measurement sleeve. As the logging instrument traverses the borehole, it logs the formations surrounding the borehole as a function of depth. The logging data is transmitted through a logging cable to a processor located at or near the logging truck to process the logging data as appropriate for use with the embodiments of the present disclosure. As with the MWD embodiment of FIG. 1, the wireline instrumentation may include any conventional logging instrumentation which can be used to measure the lithology and/or porosity of formations surrounding an earth borehole, for example, such as acoustic, neutron, gamma ray, density, photoelectric, nuclear magnetic resonance, or any other conventional logging instrument, or combinations thereof, which can be used to measure lithology.

Referring again still to FIG. 1, an apparatus 50 for predicting the performance of the drilling system 10 for drilling a series of well bores, such as well bore 14, in a given formation 24 is shown. The prediction apparatus 50 includes a prescribed set of geology and drilling mechanics models and further includes optimization, prediction, and calibration modes of operation (to be discussed further herein below with reference to FIG. 3). The prediction apparatus 50 further includes a device 52 includes any suitable commercially available computer, controller, or data processing apparatus, further being programmed for carrying out the method and apparatus as further described herein. Computer/controller 52 includes at least one input for receiving input information and/or commands, for instance, from any suitable input device (or devices) 58. Input device (devices) 58 may include a keyboard, keypad, pointing device, or the like, further including a network interface or other communications interface for receiving input information from a remote computer or database. Still further, computer/controller 52 includes at least one output for outputting information signals and/or equipment control commands. Output signals can be output to a display device 60 via signal lines 54 for use in generating a display of information contained in the output signals. Output signals can also be output to a printer device 62 for use in generating a printout 64 of information contained in the output signals. Information and/or control signals may also be output via signal lines 66 as necessary, for example, to a remote device for use in controlling one or more various drilling operating parameters of drilling rig 12, further as discussed herein. In other words, a suitable device or means is provided on the drilling system which is responsive to a predicted drilling mechanics output signal for controlling a parameter in an actual drilling of a well bore (or interval) with the drilling system. For example, drilling system may include equipment such as one of the following types of controllable motors selected from a down hole motor 70, a top drive motor 72, or a rotary table motor 74, further in which a given rpm of a respective motor may be remotely controlled. The parameter may also include one or more of the following selected from the group of weight-on-bit, rpm, mud pump flow rate, hydraulics, or any other suitable drilling system control parameter.

Computer/controller 52 provides a means for generating a geology characteristic of the formation per unit depth in accordance with a prescribed geology model. Computer/controller 52 further provides for outputting signals on signal lines 54,56 representative of the geology characteristic. Input device 58 can be used for inputting specifications of proposed drilling equipment for use in the drilling of the well bore (or interval of the well bore). The specifications include at least a bit specification of a recommended drill bit. Computer/controller 52 further provides a means for determining a predicted drilling mechanics in response to the specifications of the proposed drilling equipment as a function of the geology characteristic per unit depth, further in accordance with a prescribed drilling mechanics model. Computer/controller 52 still further provides for outputting signals on signal lines 54,56 representative of the predicted drilling mechanics.

Computer/controller 52 is programmed for performing functions as described herein, using programming techniques known in the art. In one embodiment, a computer readable medium is included, the computer readable medium having a computer program stored thereon. The computer program for execution by computer/controller 52 is for predicting the performance of a drilling system in the drilling of a well bore of a given formation. The computer program includes instructions for generating a geology characteristic of the formation per unit depth according to a prescribed geology model and outputting signals representative of the geology characteristic, the geology characteristic including at least rock strength. The computer program also includes instructions for obtaining specifications of proposed drilling equipment for use in the drilling of the well bore, the specifications including at least a bit specification of a recommended drill bit. Lastly, the computer program includes instructions for determining a predicted drilling mechanics in response to the specifications of the proposed drilling equipment as a function of the geology characteristic per unit depth according to a prescribed drilling mechanics model and outputting signals representative of the predicted drilling mechanics, the predicted drilling mechanics including at least one of the following selected from the group consisting of bit wear, mechanical efficiency, power, and operating parameters. The programming of the computer program for execution by computer/controller 52 may further be accomplished using known programming techniques for implementing the embodiments as described and discussed herein. Thus, a geology of the given formation per unit depth can be generated, and in addition a predicted drilling mechanics performance of a drilling system may be determined. Still further, the drilling operation can be advantageously optimized in conjunction with a knowledge of a predicted performance thereof, as discussed further herein below.

In a preferred embodiment, the geology characteristic includes at least rock strength. In an alternate embodiment, the geology characteristic may further include any one or more of the following which include log data, lithology, porosity, and shale plasticity.

As mentioned above, input device 58 can be used for inputting specifications of proposed drilling equipment for use in the drilling of the well bore (or interval of the well bore). In a preferred embodiment, the specifications include at least a bit specification of a recommended drill bit. In an alternate embodiment, the specifications may also include one or more specifications of the following equipment which may include down hole motor, top drive motor, rotary table motor, mud system, and mud pump. Corresponding specifications may include a maximum torque output, a type of mud, or mud pump output rating, for example, as would be appropriate with respect to a particular drilling equipment.

In a preferred embodiment, the predicted drilling mechanics include at least one of the following drilling mechanics selected from the group consisting of bit wear, mechanical efficiency, power, and operating parameters. In another embodiment, the operating parameters can include weight-on-bit, rotary rpm (revolutions-per-minute), cost, rate of penetration, and torque, to be further discussed herein below. The rate of penetration further includes an instantaneous rate of penetration (ROP) and an average rate of penetration (ROP-AVG).

Figure 2A:
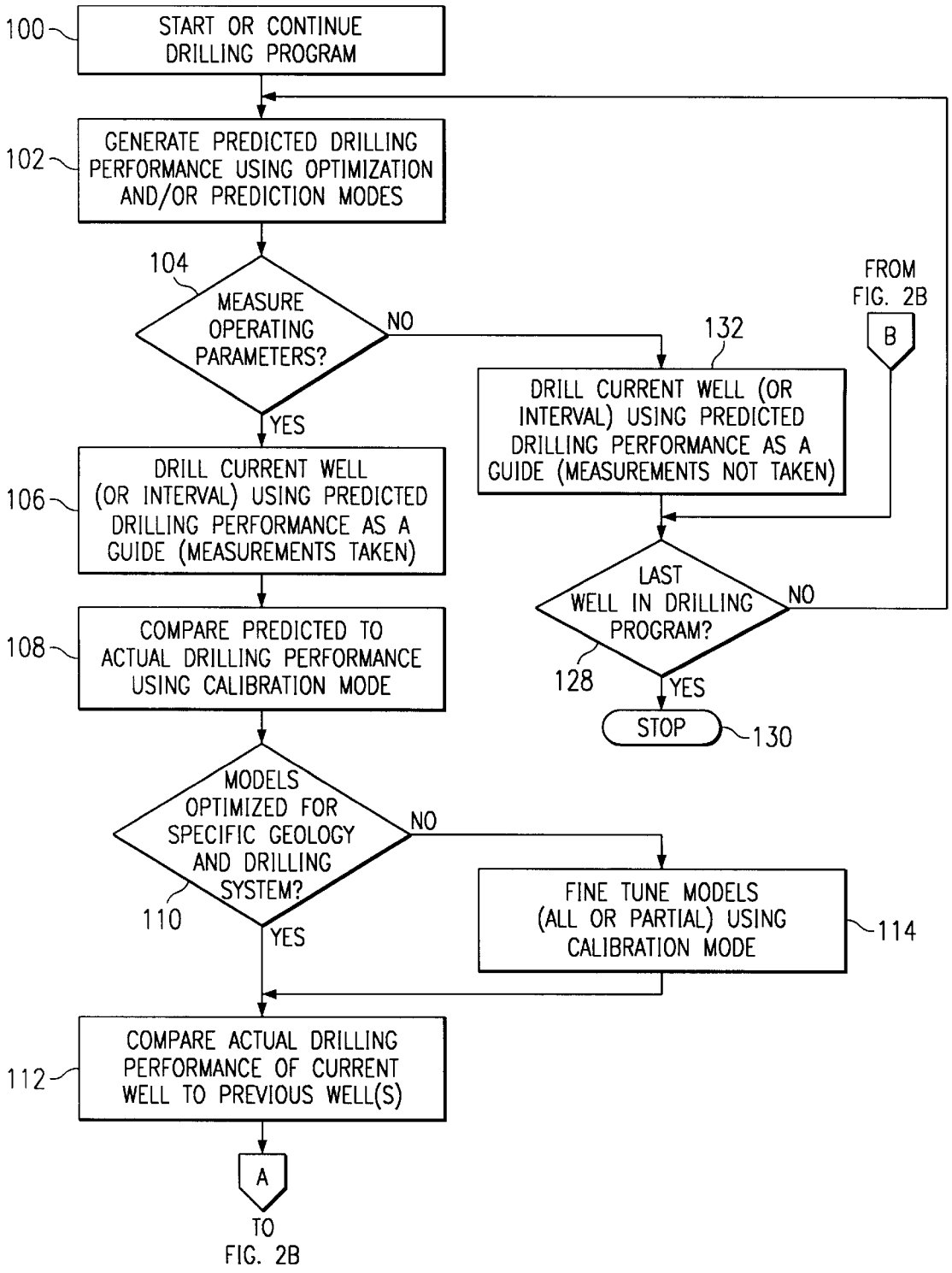
FIG. 2 illustrates a method for optimizing a drilling system and its use for the drilling of a well bore or well bores according to a prescribed drilling program in a given formation, the method further including predicting the performance of the drilling system.
Figure 2B:
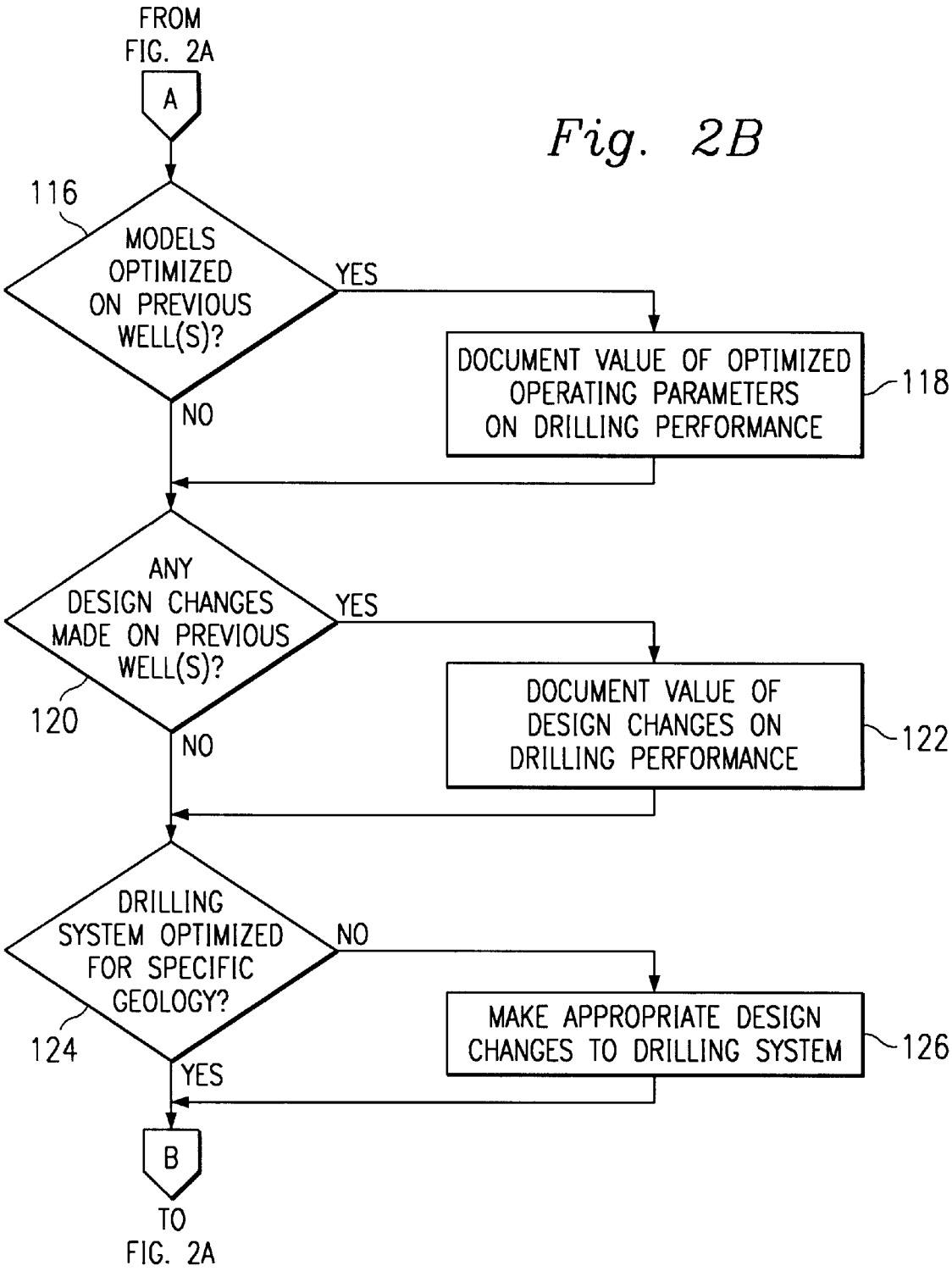

Referring now to FIG. 2, a flow diagram illustrating a method for drilling of a series of well bores in a given formation with the use of the apparatus 50 for predicting the performance of a drilling system shall now be discussed. The method is for optimizing both the drilling system and its use in a drilling program, further in conjunction with the drilling of one or more well bores (or intervals of a well bore) in the given formation. In step 100, the method includes the start of a particular drilling program or a continuation of a drilling program for the given formation. With respect to a continuation of the drilling program, it may be that the drilling program is interrupted for some reason, for example, due to equipment failure or down time, and as a result, the drilling program is only partially completed. Upon a repair or replacement of failed equipment, the method of the present disclosure can again be initiated at step 100. Note that the method of the present disclosure can be implemented at any point during a given drilling program for optimizing the particular drilling system and its use, preferably being implemented from the start of a given drilling program.

In step 102, a predicted drilling performance of the drilling system for the drilling of a well bore in the given formation is generated in accordance with the present disclosure. In addition, the predicted drilling performance for drilling of a given well bore is generated in accordance with a prescribed set of geology and drilling mechanics prediction models using at least one of the following modes selected from the group consisting of an optimization mode and a prediction mode. In other words, in the generation of the predicted drilling performance of the drilling system, either the optimization mode and/or the prediction mode may be used. The predicted drilling performance includes predicted drilling mechanics measurements. The optimization mode and the prediction mode shall be discussed further herein below, with respect to FIG. 3.

In step 104, the drilling operator makes a decision whether or not to obtain actual drilling mechanics measurements during the drilling of the given well bore (or interval of well bore). In step 106, if actual drilling mechanics measurements (e.g., operating parameters) are to be obtained, then the given well bore (or interval) is drilled with the drilling system using the predicted drilling performance as a guide. Furthermore, in step 106, during the drilling of the well bore (or interval), actual drilling mechanics measurements are taken. Alternatively, if the decision is not to obtain a measurement of operating parameters during the drilling of a given well bore (or interval of well bore), then the method proceeds to step 132, as will be discussed further herein below.

Figure 3:
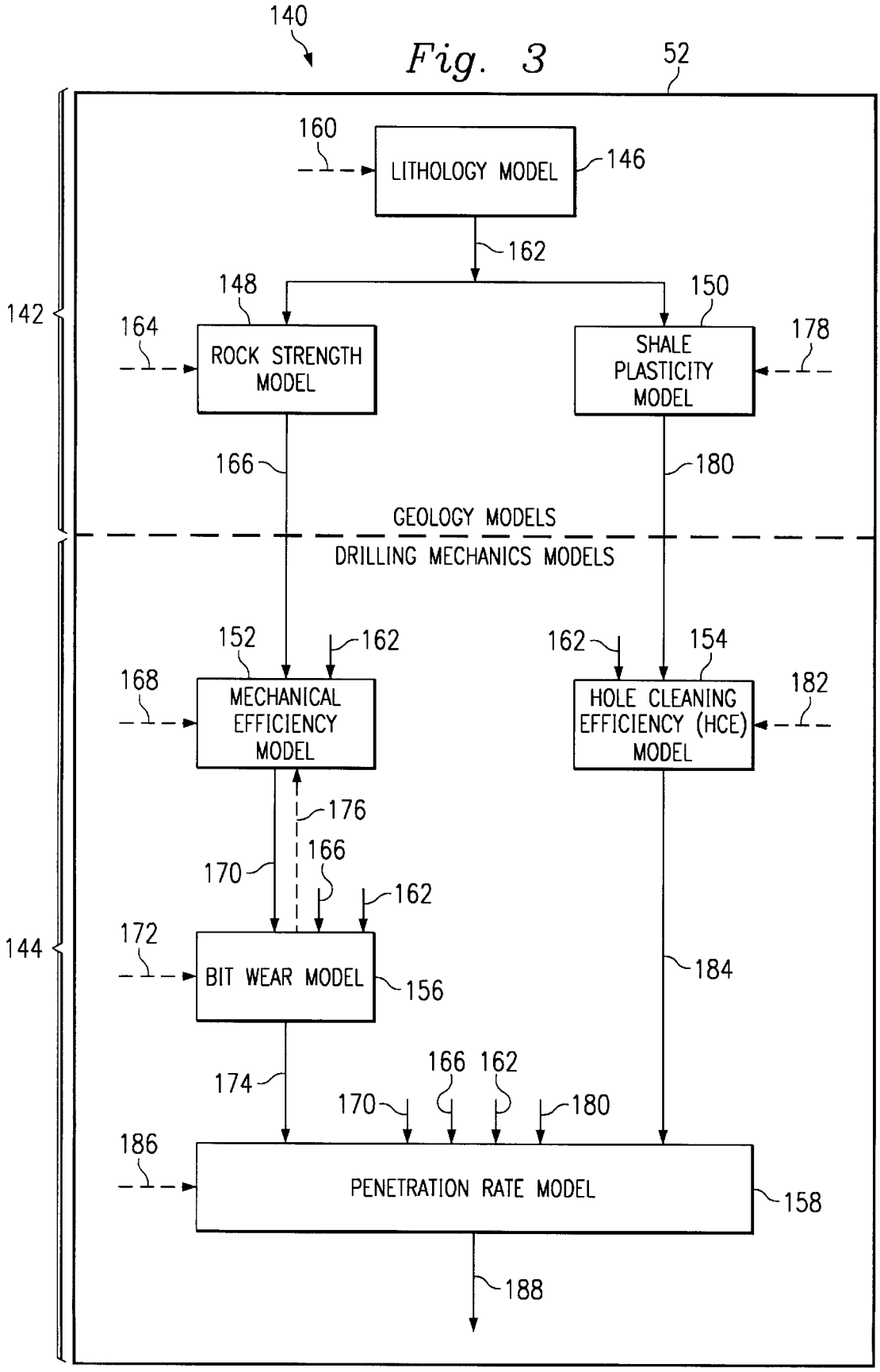
FIG. 3 illustrate geology and drilling mechanics models for use in the embodiments of the drilling performance prediction method and apparatus of the present disclosure.

In step 108, the predicted drilling performance is compared with the actual drilling performance, using a calibration mode of operation, wherein the calibration mode of operation shall be discussed further herein with reference to FIG. 3. In the comparison, actual drilling mechanics measurements are compared to predicted drilling mechanics measurements. The comparison process preferably includes overlaying a plot of the actual performance over the predicted performance (or vice versa) for visually determining any deviations between actual and predicted performance. The comparison may also be implemented with the assistance of a computer for comparing appropriate data.

With reference now to step 110 of FIG. 2, step 110 includes an inquiry of whether or not the prescribed geology and drilling mechanics models are optimized for the specific geology and drilling system. In other words, if the models are optimized for the specific geology and the specific drilling system, then the comparison of the actual drilling mechanics measurements to the predicted drilling mechanics measurements is acceptable. The method then proceeds to the step 112, in conjunction with the drilling of a subsequent well bore in the series of well bores. On the other hand, if the models are not optimized for the specific geology and drilling system, then from step 110 the method proceeds to step 114. If the comparison of the actual drilling mechanics measurements to the predicted drilling mechanics measurements in step 108 is not acceptable, then at least one of the geology and drilling mechanics models is fine tuned using the calibration mode of operation. In step 114, the geology and drilling mechanics models are fined tuned (all or partial) using the calibration mode. Using the calibration mode, all or some of the geology and drilling mechanics models are fine tuned as appropriate, further as determined from the comparison of actual versus predicted drilling performance. Upon a fine tuning of models in step 114, the method proceeds to step 112, in conjunction with the drilling of a subsequent well bore in the series of well bores.

In step 112, the actual drilling performance of the current well is compared with an actual performance of a previous well (or previous wells). Such a comparison enables a determination of whether any improvement(s) in performance have occurred. For example, the comparison may reveal that the current well was drilled in eighteen (18) days versus twenty (20) days for a previous well. Subsequent to step 112, in step 116, an inquiry is made as to whether or not the geology and drilling mechanics models were optimized on a previous well or wells. If the models were optimized, then the method proceeds to step 118. Alternatively, if the models were not optimized on a previous well or wells, then the method proceeds to step 120.

In step 118, the value of the optimized operating parameters on drilling performance is documented. Furthermore, the value of the optimized operating parameters on drilling performance is documented and/or recorded in any suitable manner for easy access and retrieval. Documentation and/or recording may include, for example, a progress report, a computer file, or a database. Step 118 thus facilitates the capture of value of the optimization of operating parameters on drilling performance. Examples of value of optimization may include various benefits, for example, economic benefit of optimized drilling, fewer trips to the particular field being drilled, less time required to drill a well, or any other suitable value measurement, etc. To illustrate further with a simple example, assume that an off-shore drilling program costs on the order of one hundred fifty thousand dollars per day ($150,000/day) to run. A savings or reduction of two (2) days per well (as a result of optimization of the drilling system and its use) would equate to a savings of three hundred thousand dollars ($300,000) per well. For a drilling program of thirty (30) wells, the combined savings as a result of an optimization of could potentially be as much as nine million dollars ($9,000,000) for the given drilling program.

In step 120, an inquiry is made as to whether or not any design changes have been made on a previous well or wells. If design changes were made, then the method proceeds to step 122. In step 122, in a manner similar to step 118, the value of design changes on drilling performance is documented. That is, the value of the design changes on drilling performance is documented and/or recorded in any suitable manner for easy access and retrieval. Documentation and/or recording may include, for example, a progress report, a computer file, or a database. Step 122 thus facilitates the capture of value of the design changes on drilling performance. Alternatively, if no design changes were made on the previous well or wells, then the method proceeds to step 124.

In step 124, an inquiry is made as to whether or not the drilling system is optimized for the specific geology. For instance, in a current well, a particular drilling equipment constraint may be severely affecting drilling performance if the drilling system has not been optimized for the specific geology. For example, if a mud pump is inadequate for a given geology, then the resulting hydraulics may also be insufficient to adequately clean hole, thus adversely impacting the drilling performance of the drilling system for the specific geology. If the drilling system is not optimized for the specific geology, then the method proceeds to step 126, otherwise, the method proceeds to step 128. In step 126, appropriate design changes are implemented or made to the drilling system. The design change may include an equipment replacement, retrofit, and/or modification, or other design change as deemed appropriate for the particular geology. The drilling system equipment and its use can thus be optimized for drilling in the given geology. The method then proceeds to step 128.

In step 128, an inquiry is made as to whether or not the last well in the drilling program has been drilled. If the last well has been drilled, then the method ends at step 130. If the last well has not yet been drilled, then the method proceeds again to step 102, and the process continues as discussed herein above.

In step 132, if drilling system operating parameters are not to be obtained, then the given well bore (or interval) is drilled with the drilling system using the predicted drilling performance as a guide without measurements being taken. In step 132, during the drilling of the well bore (or interval), no drilling mechanics measurements are taken. Upon completion of the drilling of the current well (or interval) in step 132, the method then proceeds to step 128, and the process continues as discussed herein above.

The method and apparatus of the present disclosure advantageously enables an optimization of a drilling system and its use in a drilling program to be obtained early on in a given drilling program. For example, with the present method and apparatus, an optimization might be obtained within the first few wells of a thirty well program, wherein without the present method or apparatus, optimization might not be obtained until the fifteenth well of the thirty well program. The present method further facilitates making appropriate improvements early in the drilling program. Any economic benefits resulting from the improvements made early in the drilling program are advantageously multiplied by the number of wells remaining to be drilled in the drilling program. As a result, significant and substantial savings for a company commissioning the drilling program can be advantageously achieved. Measurements may be made during drilling of each well bore, all the way through a drilling program, using the present method and apparatus for the purpose of verifying that the particular drilling system equipment is being optimally used. In addition, drilling system equipment performance can be monitored more readily with the method and apparatus of the present disclosure, further for identifying potential adverse conditions prior to their actual occurrence.

With reference now to FIG. 3, a model of a total drilling system is provided by the prediction models 140. The prediction models include geology models 142 and drilling mechanics models 144, further in accordance with the present method and apparatus. FIG. 3 illustrates an overview of the various prediction models 140 and how they are linked together. The prediction models 140 are stored in and carried out by computer/controller 52 of FIG. 1, further as discussed herein.

The geology models 142 include a lithology model 146, a rock strength model 148, and a shale plasticity model 150. The lithology model preferably includes a lithology model as described in co-pending application Ser. No. 08/970,171, filed Nov. 13, 1997, entitled "METHOD FOR QUANTIFYING THE LITHOLOGIC COMPOSITION OF FORMATIONS SURROUNDING EARTH BOREHOLES" (Attorney docket SD-97-11/5528.142) now U.S. Pat. No. 6,044,327 and incorporated herein by reference. The lithology model provides a method for quantifying lithologic component fractions of a given formation, including lithology and porosity. The lithology model utilizes any lithology or porosity sensitive log suite, for example, including nuclear magnetic resonance, photoelectric, neutron-density, sonic, gamma ray, and spectral gamma ray. The lithology model further provides an improved multi component analysis. For example, in the lithology column of FIG. 4, at 575 feet depth, four (4) components are shown which include sandstone, limestone, dolomite, and shale. Components can be weighted to a particular log or group of logs. The lithology model acknowledges that certain logs are better than others at resolving a given lithologic component. For instance, it is well known that the gamma ray log is generally the best shale indicator. A coal streak might be clearly resolved by a neutron log but missed entirely by a sonic log. Weighting factors are applied so that a given lithology is resolved by the log or group of logs that can resolve it most accurately. In addition, the lithology model allows the maximum concentration of any lithologic component to vary from zero to one-hundred percent (0–100%), thereby allowing calibration of the model to a core analysis. The lithology model also allows for limited ranges of existence for each lithologic component, further which can be based upon a core analysis. The lithology model may also include any other suitable model for predicting lithology and porosity.

The rock strength model 148 preferably includes a rock strength model as described in U.S. Pat. No. 5,767,399, issued Jun. 16, 1998, entitled "METHOD OF ASSAYING COMPRESSIVE STRENGTH OF ROCK" (Attorney docket BT-1322/5528.334) and incorporated herein by reference. The rock strength model provides a method for determining a confinement stress and rock strength in a given formation. The rock strength model may also include any other suitable model for predicting confinement stress and rock strength.

The shale plasticity model 150 preferably includes a shale plasticity model as described in co-pending patent application Ser. No. 09/081,483, filed May 18, 1998, entitled "METHOD AND APPARATUS FOR QUANTIFYING SHALE PLASTICITY FROM WELL LOGS" (Attorney docket SD-98-004/5528.328) and incorporated herein by reference. The shale plasticity model provides a method for quantifying shale plasticity of a given formation. The shale plasticity model may also include any other suitable model for predicting shale plasticity. The geology models thus provide for generating a model of the particular geologic application of a given formation.

The drilling mechanics models 144 include a mechanical efficiency model 152, a hole cleaning efficiency model 154, a bit wear model 156, and a penetration rate model 158. The mechanical efficiency model 152 preferably includes a mechanical efficiency model as described in co-pending patent application Ser. No. 09/048,360, filed Mar. 26, 1998 entitled "METHOD OF ASSAYING DOWNHOLE OCCURRENCES AND CONDITIONS" (Attorney docket BT-1307 CIP1/5528.322) and incorporated herein by reference. The mechanical efficiency model provides a method for determining the bit mechanical efficiency. In the mechanical efficiency model, mechanical efficiency is defined as the percentage of the torque that cuts. The remaining torque is dissipated as friction. The mechanical efficiency model a) reflects the 3-D bit geometry, b) is linked to cutting torque, c) takes into account the effect of operating constraints, and d) makes use of a torque and drag analysis.

With respect to the hole cleaning efficiency (HCE) model 154, the model takes into account drilling fluid type, hydraulics, lithology, and shale plasticity. The hole cleaning efficiency model is a measure of an effectiveness of the drilling fluid and hydraulics. If the hole cleaning efficiency is low, then unremoved or slowly removed cuttings may have an adverse impact upon drilling mechanics.

The bit wear model 156 preferably includes a bit wear model as described in U.S. Pat. No. 5,794,720, issued Aug. 18, 1998 and entitled "METHOD OF ASSAYING DOWNHOLE OCCURRENCES AND CONDITIONS" (Attorney docket BT-1307 CIP1/5528.337) and incorporated herein by reference. The bit wear model provides a method for determining bit wear, i.e., to predict bit life and formation abrasivity. Furthermore, the bit wear model is used for applying a work rating to a given bit.

The penetration rate model 158 preferably includes a penetration rate model as described in U.S. Pat. No. 5,704,436, issued Jan. 16, 1998 and entitled "METHOD OF REGULATING DRILLING CONDITIONS APPLIED TO A WELL BIT" (Attorney docket BT-1321/5528.335) and incorporated herein by reference. The penetration rate model provides a method for optimizing operating parameters and predicting penetration rate of the bit and drilling system. The ROP model provides for one or more of the following including: maximizing a penetration rate, establishing a power limit to avoid impact damage to the bit, respecting all operating constraints, optimizing operating parameters, and minimizing bit induced vibrations.

The drilling mechanics models 144 as described herein provide for generating a comprehensive model of the particular drilling system being used or proposed for use in the drilling of a well bore, interval(s) of a well bore, or series of well bores in a given drilling operation. The drilling mechanics models 144 further allow for the generation of a drilling mechanics performance prediction of the drilling system in a given geology. A comparison of actual performance to predicted performance can be used for history matching the drilling mechanics models, as may be required, for optimizing the respective drilling mechanics models.

With reference still to FIG. 3, the present method and apparatus include several modes of operation. The modes of operation include an optimization mode, a prediction mode, and a calibration mode. For the various modes of operation, predicted economics can be included for providing a measure of the number of fewer days per well which can be achieved when a drilling system is optimized using the method and apparatus of the present disclosure.

Optimization Mode

In the optimization mode, the purpose is to optimize operating parameters of the drilling system. Optimization criteria include 1) maximize penetration rate; 2) avoid impact damage to the bit; 3) respect all operating constraints; and 4) minimize bit-induced vibrations.

In the optimization mode, the lithology model 146 receives data from porosity logs, lithology logs and/or mud logs on input 160. The porosity or lithology logs may include nuclear magnetic resonance (NMR), photoelectric, neutron-density, sonic, gamma ray, and spectral gamma ray, or any other log sensitive to porosity or lithology. The mud logs are used to identify non-shale lithology components. In response to the log inputs, the lithology model 146 provides a measure of lithology and porosity of the given formation per unit depth on output 162. With respect to lithology, the output 162 preferably includes a volume fraction of each lithologic component of the formation per unit depth. With respect to porosity, the output 162 preferably includes a volume fraction of pore space within the rock of the formation per unit depth. The measure of lithology and porosity on output 162 is input to the rock strength model 148, shale plasticity model 150, mechanical efficiency model 152, hole cleaning efficiency model 154, bit wear model 162, and penetration rate model 158.

With respect to the rock strength model 148, in addition to receiving the measure of lithology and porosity output 162, rock strength model 148 further receives mud weight and pore pressure data at input 164. Mud weight is used to calculate overbalance. Pore pressure is used to calculate overbalance and alternatively, design overbalance may be used to estimate pore pressure. In response to the inputs, the rock strength model 148 produces a measure of confinement stress and rock strength of the given formation per unit depth on output 166. More particularly, the rock strength model produces a measure of overbalance, effective pore pressure, confinement stress, unconfined rock strength, and confined rock strength. Overbalance is defined as mud weight minus pore pressure. Effective pore pressure is similar to pore pressure, but also reflects permeability reduction in shales and low porosity non-shales. Confinement stress is an estimate of in-situ confinement stress of rock. Unconfined rock strength is rock strength at the surface of the earth. Lastly, confined rock strength is rock strength under in-situ confinement stress conditions. As shown, the rock strength output 166 is input to the mechanical efficiency model 152, bit wear model 162, and penetration rate model 158.

With respect to the mechanical efficiency model 152, in addition to receiving the lithology and porosity output 162 and confinement stress and rock strength output 166, mechanical efficiency model 152 further receives input data relating to operating constraints, 3-D bit model, and torque and drag, all relative to the drilling system, on input 168. Operating constraints can include a maximum torque, maximum weight-on-bit (WOB), maximum and minimum RPM, and maximum penetration rate. In particular, with respect to mechanical efficiency, operating constraints on the drilling system include maximum torque, maximum weight-on-bit (WOB), minimum RPM, and maximum penetration rate. Operating constraints limit an amount of optimization that can be achieved with a particular drilling system. Further with respect to evaluating the effect of operating constraints on mechanical efficiency, while not all constraints affect both mechanical efficiency and power, it is necessary to know all of the constraints in order to quantify the effects of those constraints which have an effect upon either mechanical efficiency or power. The 3-D bit model input includes a bit work rating and a torque-WOB signature. Lastly, the torque and drag analysis includes a directional proposal, casing and drill string geometry, mud weight and flow rate, friction factors, or torque and drag measurements. The torque and drag analysis is needed to determine how much surface torque is actually transmitted to the bit. Alternatively, measurements of off-bottom and on-bottom torque could be used in lieu of the torque and drag analysis. In addition, near bit measurements from an measurement while drilling (MWD) system could also be used in lieu of the torque and drag analysis. In response to the input information, the mechanical efficiency model 152 produces a measure of mechanical efficiency, constraint analysis, predicted torque, and optimum weight-on-bit (WOB) for the drilling system in the given formation per unit depth on output 170. More particularly, the mechanical efficiency model 152 provides a measure of total torque, cutting torque, frictional torque, mechanical efficiency, a constraint analysis, and an optimum WOB. The total torque represents a total torque applied to the bit. The cutting torque represents the cutting component of the total torque. The frictional torque is the frictional component of the total torque. With mechanical efficiency model 152, the mechanical efficiency is defined as the percentage of the total torque that cuts. The constraint analysis quantifies the reduction in mechanical efficiency from a theoretical maximum value due to each operating constraint. Lastly, an optimum WOB is determined for which the WOB maximizes the penetration rate while respecting all operating constraints. The optimum WOB is used by the penetration rate model 158 to calculate an optimum RPM. Furthermore, mechanical efficiency model 152 utilizes a measure of bit wear from a previous iteration as input also, to be described further below with respect to the bit wear model.

With respect now to bit wear model 156, the bit wear model receives input from the lithology model via output 162, the rock strength model via output 166, and the mechanical efficiency model via output 170. In addition, the bit wear model 156 further receives 3-D bit model data on input 172. The 3-D bit model input includes a bit work rating and a torque-WOB signature. In response to the inputs of lithology, porosity, mechanical efficiency, rock strength, and the 3-D bit model, the bit wear model 156 produces a measure of specific energy, cumulative work, formation abrasivity, and bit wear with respect to the bit in the given formation per unit depth on output 174. The specific energy is the total energy applied at the bit, which is equivalent to the bit force divided by the bit cross-sectional area. The cumulative work done by the bit reflects both the rock strength and the mechanical efficiency. The formation abrasivity measure models an accelerated wear due to formation abrasivity. Lastly, the measure of bit wear corresponds to a wear condition that is linked to bit axial contact area and mechanical efficiency. In addition to output 174, bit wear model 156 further includes providing a measure of bit wear from a previous iteration to the mechanical efficiency model 152 on output 176, wherein the mechanical efficiency model 152 further utilizes the bit wear measure from a previous iteration in the calculation of its mechanical efficiency output data on output 170.

Prior to discussing the penetration rate model 158, we first return to the shale plasticity model 150. As shown in FIG. 3, the shale plasticity model 150 receives input from the lithology model. In particular, shale volume is provided from the lithology model 146. In addition to receiving the lithology and porosity output 162, the shale plasticity model 150 further receives log data from prescribed well logs on input 178, the well logs including any log sensitive to clay type, clay water content, and clay volume. Such logs may include nuclear magnetic resonance (NMR), neutron-density, sonic-density, spectral gamma ray, gamma ray, and cation exchange capacity (CEC). In response to the inputs, the shale plasticity model 150 produces a measure of shale plasticity of the formation per unit depth on output 180. In particular, shale plasticity model 150 provides a measure of normalized clay type, normalized clay water content, normalized clay volume, and shale plasticity. The normalized clay type identifies a maximum concentration of smectites, wherein smectite is the clay type most likely to cause clay swelling. The normalized clay water content identifies the water content where a maximum shale plasticity occurs. The normalized clay volume identifies the range of clay volume where plastic behavior can occur. Lastly, shale plasticity is a weighted average of the normalized clay properties and reflects an overall plasticity.

With reference to the hole cleaning efficiency model 154, model 154 receives a shale plasticity input from the shale plasticity model 150 and a lithology input from the lithology model 146. In addition to receiving the lithology model output 162 and the shale plasticity model output 180, the hole cleaning efficiency model 154 further receives hydraulics and drilling fluid data on input 182. In particular, the hydraulics input can include any standard measure of hydraulic efficiency, such as, hydraulic horsepower per square inch of bit diameter. In addition, the drilling fluid type may include water base mud, oil base mud, polymer, or other known fluid type. In response to the inputs, the hole cleaning efficiency model 154 produces a measure of a predicted hole cleaning efficiency of the bit and drilling system in the drilling of a well bore (or interval) in the formation per unit depth on output 184. Hole cleaning efficiency is defined herein as the actual over the predicted penetration rate. While the other drilling mechanics models assume perfect hole cleaning, the hole cleaning efficiency (HCE) model is a measure of correction to the penetration rate prediction to compensate for hole cleaning that deviates from ideal behavior. Thus, the measure of hole cleaning efficiency (HCE) reflects the effects of lithology, shale plasticity, hydraulics, and drilling fluid type on penetration rate.

With reference now to the penetration rate model 158, the penetration rate model 158 receives mechanical efficiency, predicted torque, and optimum WOB via output 170 of the mechanical efficiency model 152. Model 158 further receives bit wear via output 174 of the bit wear model 156, rock strength via output 166 of rock strength model 148, and predicted HCE via output 184 of HCE model 154. In addition, the penetration rate model 158 further receives operating constraints information on input 186. In particular, the operating constraints include a maximum torque, maximum weight-on-bit (WOB), maximum and minimum RPM, and maximum penetration rate. Further with respect to evaluating the effect of operating constraints on power, while not all constraints affect both mechanical efficiency and power, it is necessary to know all of the constraints in order to quantify the effects of those constraints which have an effect upon either mechanical efficiency or power. In response to the inputs, the penetration rate model 158 produces a power level analysis, a constraint analysis, and in addition, a measure of optimum RPM, penetration rate, and economics of the bit and drilling system in the drilling of a well bore (or interval) in the formation per unit depth on output 188. More particularly, the power level analysis includes a determination of a maximum power limit. The maximum power limit maximizes penetration rate without causing impact damage to the bit. The operating power level may be less than the maximum power limit due to operating constraints. The constraint analysis includes quantifying the reduction in operating power level from the maximum power limit due to each operating constraint. The optimum RPM is that RPM which maximizes penetration rate while respecting all operating constraints. The penetration rate is the predicted penetration rate at the optimum WOB and optimum RPM. Lastly, economics can include the industry standard cost per foot analysis.

Prediction Mode

In the prediction mode, the object or purpose is to predict drilling performance with user-specified operating parameters that are not necessarily optimal. Operating constraints do not apply in this mode. The prediction mode is essentially similar to the optimization mode, however with exceptions with respect to the mechanical efficiency model 152, bit wear model 156, and the penetration rate model 158, further as explained herein below. The hole cleaning efficiency model 154 is the same for both the optimization and prediction modes, since the hole cleaning efficiency is independent of the mechanical operating parameters (i.e., user-specified WOB and user-specified RPM).

With respect to the mechanical efficiency model 152, in the prediction mode, in addition to receiving the lithology and porosity output 162 and confinement stress and rock strength output 166, mechanical efficiency model 152 further receives input data relating to user-specified operating parameters and a 3-D bit model, relative to the drilling system, on input 168. The user-specified operating parameters for the drilling system can include a user-specified weight-on-bit (WOB) and a user-specified RPM. This option is used for evaluating "what if" scenarios. The 3-D bit model input includes a bit work rating and a torque-WOB signature. In response to the input, the mechanical efficiency model 152 produces a measure of mechanical efficiency for the drilling system in the given formation per unit depth on output 170. More particularly, the mechanical efficiency model 152 provides a measure of total torque, cutting torque, frictional torque, and mechanical efficiency. The total torque represents the total torque applied to the bit. In the prediction mode, the total torque corresponds to the user-specified weight-on-bit. The cutting torque represents the cutting component of the total torque on the bit. The frictional torque is the frictional component of the total torque on the bit.

With mechanical efficiency model 152, the mechanical efficiency is defined as the percentage of the total torque that cuts. The prediction mode may also include an analysis of mechanical efficiency by region, that is, by region of mechanical efficiency with respect to a bit's mechanical efficiency torque-WOB signature. A first region of mechanical efficiency is defined by a first weight-on-bit (WOB) range from zero WOB to a threshold WOB, wherein the threshold WOB corresponds to a given WOB necessary to just penetrate the rock, further corresponding to a zero (or negligible) depth of cut The first region of mechanical efficiency further corresponds to a drilling efficiency of efficient grinding. A second region of mechanical efficiency is defined by a second weight-on-bit range from the threshold WOB to an optimum WOB, wherein the optimum WOB corresponds to a given WOB necessary to just achieve a maximum depth of cut with the bit, prior to the bit body contacting the earth formation. The second region of mechanical efficiency further corresponds to a drilling efficiency of efficient cutting. A third region of mechanical efficiency is defined by a third weight-on-bit range from the optimum WOB to a grinding WOB, wherein the grinding WOB corresponds to a given WOB necessary to cause cutting torque of the bit to just be reduced to essentially zero or become negligible. The third region of mechanical efficiency further corresponds to a drilling efficiency of inefficient cutting. Lastly, a fourth region of mechanical efficiency is defined by a fourth weight-on-bit range from the grinding WOB and above. The fourth region of mechanical efficiency further corresponds to a drilling efficiency of inefficient grinding. With respect to regions three and four, while the bit is at a maximum depth of cut, as WOB is further increased, frictional contact of the bit body with the rock formation is also increased.

Furthermore, mechanical efficiency model 152 utilizes a measure of bit wear from a previous iteration as input also, to be described further below with respect to the bit wear model.

With respect now to bit wear model 156, in the prediction mode, the bit wear model receives input from the lithology model via output 162, the rock strength model via output 166, and the mechanical efficiency model via output 170. In addition, the bit wear model 156 further receives 3-D bit model data on input 172. The 3-D bit model input includes a bit work rating and a torque-WOB signature. In response to the inputs of lithology, porosity, mechanical efficiency, rock strength, and the 3-D bit model, the bit wear model 156 produces a measure of specific energy, cumulative work, formation abrasivity, and bit wear with respect to the bit in the given formation per unit depth on output 174. The specific energy is the total energy applied at the bit, which is equivalent to the bit force divided by the bit cross-sectional area. Furthermore, the calculation of specific energy is based on the user-specified operating parameters. The cumulative work done by the bit reflects both the rock strength and the mechanical efficiency. The calculation of cumulative work done by the bit is also based on the user-specified operating parameters. The formation abrasivity measure models an accelerated wear due to formation abrasivity. Lastly, the measure of bit wear corresponds to a wear condition that is linked to bit axial contact area and mechanical efficiency. As with the calculations of specific energy and cumulative work, the bit wear calculation is based on the user-specified operating parameters. In addition to output 174, bit wear model 156 further includes providing a measure of bit wear from a previous iteration to the mechanical efficiency model 152 on output 176, wherein the mechanical efficiency model 152 further utilizes the bit wear measure from a previous iteration in the calculation of its mechanical efficiency output data on output 170.

With reference now to the penetration rate model 158, the penetration rate model 158 receives mechanical efficiency and predicted torque via output 170 of the mechanical efficiency model 152. Model 158 further receives bit wear via output 174 of the bit wear model 156, rock strength via output 166 of rock strength model 148, and predicted HCE via output 184 of HCE model 154. In addition, the penetration rate model 158 further receives user-specified operating parameters on input 186. In particular, the user-specified operating parameters include a user-specified weight-on-bit (WOB) and a user-specified RPM. As mentioned above, this prediction mode of operation is used to evaluate "what if" scenarios. In response to the inputs, the penetration rate model 158 produces a power level analysis and, in addition, a measure of penetration rate and economics of the bit and drilling system in the predicted drilling of a well bore (or interval) in the formation per unit depth on output 188. More particularly, the power level analysis includes a determination of a maximum power limit. The maximum power limit corresponds to a prescribed power which, when applied to the bit, maximizes penetration rate without causing impact damage to the bit. The operating power level resulting from the user-specified operating parameters may be less than or greater than the maximum power limit. Any operating power levels which exceed the maximum power limit of the bit can be flagged automatically, for example, by suitable programming, for indicating or identifying those intervals of a well bore where impact damage to the bit is likely to occur. The power level analysis would apply to the particular drilling system and its use in the drilling of a well bore (or interval) in the given formation. In addition, the penetration rate is the predicted penetration rate at user-specified WOB and user-specified RPM. Lastly, economics includes the industry standard cost per foot analysis.

Calibration Mode

Lastly, in the calibration mode, the object or purpose is to calibrate the drilling mechanics models to measured operating parameters. In addition, the geology models may be calibrated to measured core data. Furthermore, it is possible to partially or fully calibrate any model or group of models. Similarly as with the prediction mode, operating constraints do not apply in the calibration mode.

Beginning first with the geology models 142, measured core data may be used to calibrate each geology model. With respect to the lithology model, the lithology model 146 receives data from porosity logs, lithology logs and/or mud logs, and core data on input 160. As mentioned above, the porosity or lithology logs may include nuclear magnetic resonance (NMR), photoelectric, neutron-density, sonic, gamma ray, and spectral gamma ray, or any other log sensitive to porosity or lithology. The mud logs are used to identify non-shale lithology components. Core data includes measured core data which may be used to calibrate the lithology model. Calibration of the lithology model with measured core data allows the predicted lithologic composition to be in better agreement with measured core composition. Measured core porosity may also be used to calibrate any log-derived porosity. In response to the inputs, the lithology model 146 provides a measure of lithology and porosity of the given formation per unit depth on output 162. With respect to calibrated lithology, the output 162 preferably includes a volume fraction of each desired lithologic component of the formation per unit depth calibrated to a core analysis and/or a mud log. With respect to calibrated porosity, the log-derived output 162 preferably is calibrated to measured core porosity. Also, less accurate logs may be calibrated to more accurate logs. The calibration of lithology and porosity on output 162 is input to the rock strength model 148, shale plasticity model 150, mechanical efficiency model 152, hole cleaning efficiency model 154, bit wear model 162, and penetration rate model 158.

With respect to the rock strength model 148, inputs and outputs are similar to that as discussed herein above with respect to the optimization mode. However in the calibration mode, the input 164 further includes core data. Core data includes measured core data which may be used to calibrate the rock strength model. Calibration allows the predicted rock strength to be in better agreement with measured core strength. In addition, measured pore pressure data may also be used to calibrate the confinement stress calculation.

With respect to the shale plasticity model 150, inputs and outputs are similar to that as discussed herein above with respect to the optimization mode. However in the calibration mode, the input 178 further includes core data. Core data includes measured core data which may be used to calibrate the shale plasticity model. Calibration allows the predicted plasticity to be in better agreement with measured core plasticity. In response to the inputs, the shale plasticity model 150 provides a measure of shale plasticity of the given formation per unit depth on output 180. With respect to calibrated shale plasticity, the output 180 preferably includes a weighted average of the normalized clay properties that reflects the overall plasticity calibrated to a core analysis.

With respect to the mechanical efficiency model 152, inputs and outputs are similar to that as discussed herein above with respect to the optimization mode, with the following exceptions. In the calibration mode, input 168 does not include operating constraints or torque and drag analysis, however, in the calibration mode, the input 168 does include measured operating parameters. Measured operating parameters include weight-on-bit (WOB), RPM, penetration rate, and torque (optional), which maybe used to calibrate the mechanical efficiency model. In response to the inputs, the mechanical efficiency model 152 provides a measure of total torque, cutting torque, frictional torque, and calibrated mechanical efficiency on output 170. With respect to total torque, total torque refers to the total torque applied to the bit, further which is calibrated to measured torque if data is available. Cutting torque refers to the cutting component of total torque on bit, further which is calibrated to an actual mechanical efficiency. Frictional torque refers to the frictional component of the total torque on bit, further which is calibrated to the actual mechanical efficiency. With respect to calibrated mechanical efficiency, mechanical efficiency is defined as the percentage of the total torque that cuts. The predicted mechanical efficiency is calibrated to the actual mechanical efficiency. The calibration is more accurate if measured torque data is available. However, it is possible to partially calibrate the mechanical efficiency if torque data is unavailable, by using a predicted torque along with the other measured operating parameters.

In the calibration mode, an analysis of mechanical efficiency by region, that is, by region of mechanical efficiency with respect to a bit's mechanical efficiency torque-WOB signature, may also be included. As indicated above, the first region of mechanical efficiency is defined by a first weight-on-bit (WOB) range from zero WOB to a threshold WOB, wherein the threshold WOB corresponds to a given WOB necessary to just penetrate the rock, further corresponding to a zero (or negligible) depth of cut. The first region of mechanical efficiency further corresponds to a drilling efficiency of efficient grinding. The second region of mechanical efficiency is defined by a second weight-on-bit range from the threshold WOB to an optimum WOB, wherein the optimum WOB corresponds to a given WOB necessary to just achieve a maximum depth of cut with the bit, prior to the bit body contacting the earth formation. The second region of mechanical efficiency further corresponds to a drilling efficiency of efficient cutting. The third region of mechanical efficiency is defined by a third weight-on-bit range from the optimum WOB to a grinding WOB, wherein the grinding WOB corresponds to a given WOB necessary to cause cutting torque of the bit to just be reduced to essentially zero or become negligible. The third region of mechanical efficiency further corresponds to a drilling efficiency of inefficient cutting. Lastly, the fourth region of mechanical efficiency is defined by a fourth weight-on-bit range from the grinding WOB and above. The fourth region of mechanical efficiency further corresponds to a drilling efficiency of inefficient grinding. With respect to regions three and four, while the bit is at a maximum depth of cut, as WOB is further increased, frictional contact of the bit body with the rock formation is also increased.

With respect to the bit wear model 156, inputs and outputs are similar to that as discussed herein above with respect to the optimization mode. However in the calibration mode, the input 172 further includes bit wear measurement. Bit wear measurement includes a measure of a current axial contact area of the bit. Furthermore, the bit wear measurement is correlated with the cumulative work done by the bit based on the measured operating parameters. In response to the inputs, the bit wear model 156 provides a measure of specific energy, cumulative work, calibrated formation abrasivity, and calibrated bit work rating with respect to the given drilling system and formation per unit depth on output 174. With respect to specific energy, specific energy corresponds to the total energy applied at the bit. In addition, specific energy is equivalent to the bit force divided by the bit cross-sectional area, wherein the calculation is further based on the measured operating parameters. With respect to cumulative work, the cumulative work done by the bit reflects both the rock strength and mechanical efficiency. In addition, the calculation of cumulative work is based on the measured operating parameters. With respect to calculated formation abrasivity, the bit wear model accelerates wear due to formation abrasivity. Furthermore, the bit wear measurement and cumulative work done can be used to calibrate the formation abrasivity. Lastly, with respect to calibrated bit work rating, the dull bit wear condition is linked to cumulative work done. In calibration mode, the bit work rating of a given bit can be calibrated to the bit wear measurement and cumulative work done.

With respect to the hole cleaning efficiency model 154, inputs and outputs are similar to that as discussed herein above with respect to the optimization mode. However, in the calibration mode, the hole cleaning efficiency is calibrated by correlating to the measured HCE in the penetration rate model, further as discussed herein below.

With respect to the penetration rate model 158, inputs and outputs are similar to that as discussed herein above with respect to the optimization mode. However, in the calibration mode, input 186 does not include operating constraints, but rather, the input 168 does include measured operating parameters and bit wear measurement. Measured operating parameters include weight-on-bit (WOB), RPM, penetration rate, and torque (optional). Bit wear measurement is a measure of current axial contact area of the bit and also identifies the predominant type of wear including uniform and non-uniform wear. For example, impact damage is a form of non-uniform wear. Measured operating parameters and bit wear measurements may be used to calibrate the penetration rate model. In response to the inputs, the penetration rate model 158 provides a measure of calibrated penetration rate, calibrated HCE, and calibrated power limit. With respect to calibrated penetration rate, calibrated penetration rate is a predicted penetration rate at the measured operating parameters. The predicted penetration rate is calibrated to the measured penetration rate using HCE as the correction factor. With respect to calibrated HCE, HCE is defined as the actual over the predicted penetration rate. The predicted HCE from the HCE model is calibrated to the HCE calculated in the penetration rate model. Lastly, with respect to the calibrated power limit, the maximum power limit maximizes penetration rate without causing impact damage to the bit. If the operating power level resulting from the measured operating parameters exceeds the power limit then impact damage is likely. The software or computer program for implementing the predicting of the performance of a drilling system can be set up to automatically flag any operating power level which exceeds the power limit. Still further, the power limit may be adjusted to reflect the type of wear actually seen on the dull bit. For example, if the program flags intervals where impact damage is likely, but the wear seen on the dull bit is predominantly uniform, then the power limit is probably too conservative and should be raised.

A performance analysis may also be performed which includes an analysis of the operating parameters. Operating parameters to be measured include WOB, TOB (optional), RPM, and ROP. Near bit measurements are preferred for more accurate performance analysis results. Other performance analysis measurements include bit wear measurements, drilling fluid type and hydraulics, and economics.

Overview

With reference again to FIG. 1, apparatus 50 for predicting the performance of a drilling system 10 for the drilling of a well bore 14 in a given formation 24 will now be further discussed. The prediction apparatus 50 includes a computer/controller 52 for generating a geology characteristic of the formation per unit depth according to a prescribed geology model and for outputting signals representative of the geology characteristic. Preferably, the geology characteristic includes at least rock strength. In addition, the geology characteristic generating means 52 may further generate at least one of the following additional characteristics selected from the group consisting of log data, lithology, porosity, and shale plasticity.

Input device(s) 58 is (are) provided for inputting specifications of proposed drilling equipment for use in the drilling of the well bore, wherein the specifications include at least a bit specification of a recommended drill bit. In addition, input device(s) 58 may further be used for inputting additional proposed drilling equipment input specification(s) which may also include at least one additional specification of proposed drilling equipment selected from the group consisting of down hole motor, top drive motor, rotary table motor, mud system, and mud pump.

Lastly, computer/controller 52 is further for determining a predicted drilling mechanics in response to the specifications of the proposed drilling equipment as a function of the geology characteristic per unit depth according to a prescribed drilling mechanics model. Computer/controller 52 is further for outputting signals representative of the predicted drilling mechanics, the predicted drilling mechanics including at least one of the following selected from the group consisting of bit wear, mechanical efficiency, power, and operating parameters. The operating parameters may include at least one of the following selected from the group consisting of weight-on-bit, rotary rpm (revolutions-per-minute), cost, rate of penetration, and torque. Additionally, rate of penetration includes instantaneous rate of penetration (ROP) and average rate of penetration (ROP-AVG).

As illustrated in FIG. 1, display 60 and printer 62 each provide a means responsive to the geology characteristic output signals and the predicted drilling mechanics output signals for generating a display of the geology characteristic and predicted drilling mechanics per unit depth. With respect to printer 62, the display of the geology characteristic and predicted drilling mechanics per unit depth includes a printout 64. In addition, computer/controller 52 may further provide drilling operation control signals on line 66, relating to given predicted drilling mechanics output signals. In such an instance, the drilling system could further include one or more devices which are responsive to a drilling operation control signal based upon a predicted drilling mechanics output signal for controlling a parameter in an actual drilling of the well bore with the drilling system. Exemplary parameters may include at least one selected from the group consisting of weight-on-bit, rpm, pump flow, and hydraulics.

Display of predicted performance

Figure 4A:
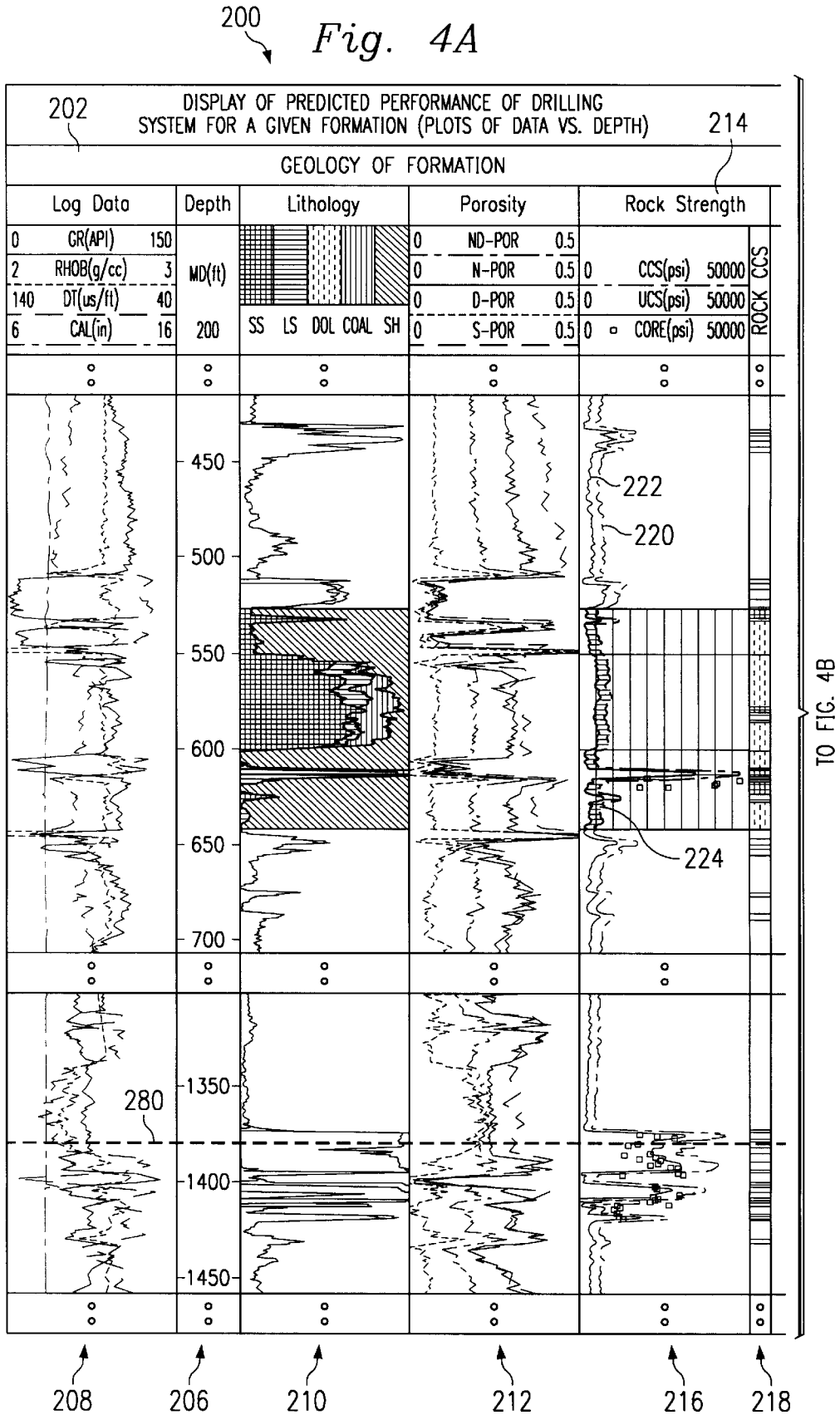
FIGS. 4 (4*a*, 4*b*, and 4*c*) illustrates one embodiment of a display of predicted performance of a drilling system for a given formation according to the method and apparatus of the present disclosure.
Figure 4B:
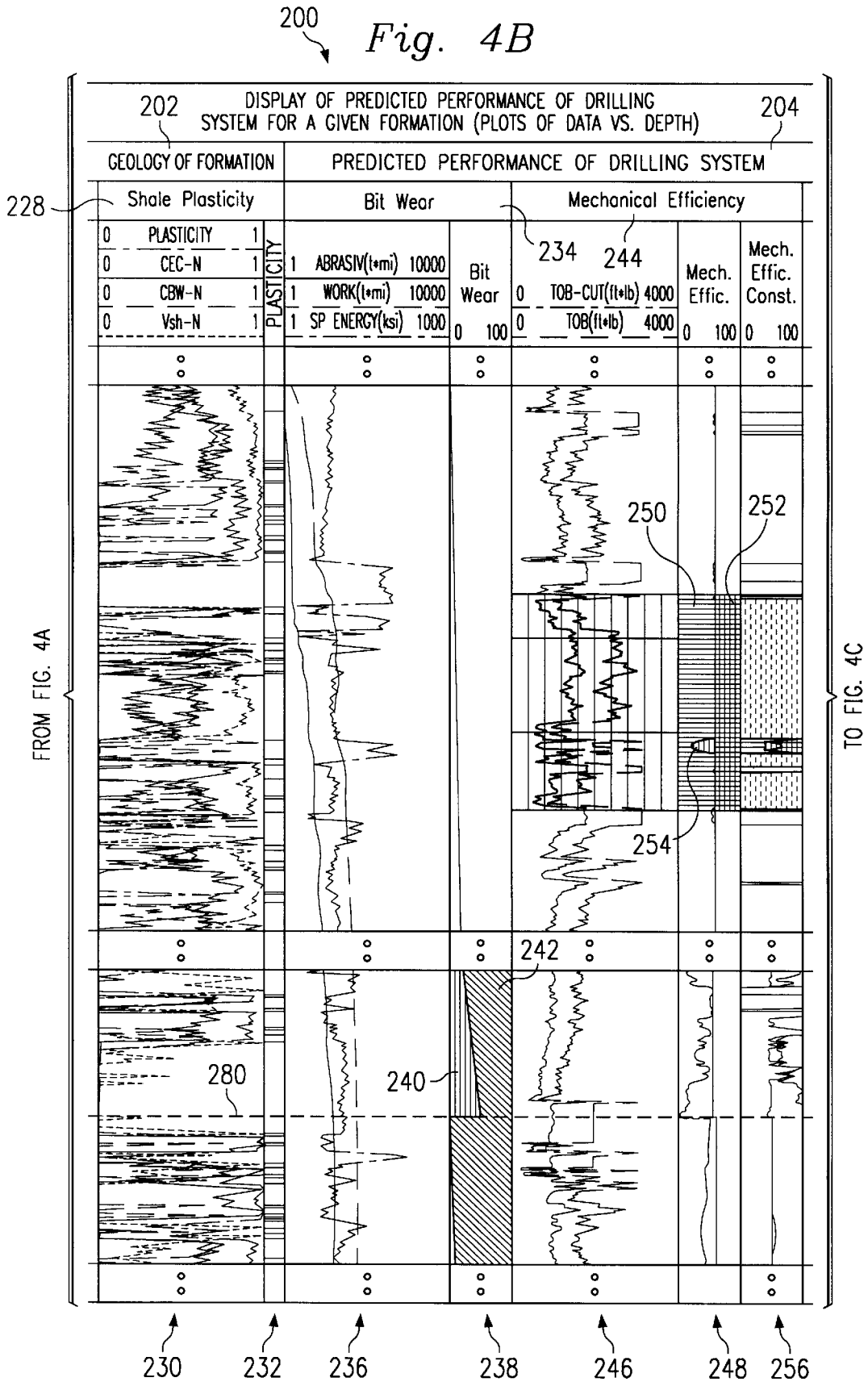

With reference now to FIG. 4, a display 200 of predicted performance of the drilling system 50 (FIG. 1) for a given formation 24 (FIG. 1) shall now be described in further detail. Display 200 includes a display of geology characteristic 202 and a display of predicted drilling mechanics 204. The display of the geology characteristic 202 includes at least one graphical representation selected from the group consisting of a curve representation, a percentage graph representation, and a band representation. In addition, the display of the predicted drilling mechanics 204 includes at least one graphical representation selected from the group consisting of a curve representation, a percentage graph representation, and a band representation. In a preferred embodiment, the at least one graphical representation of the geology characteristic 202 and the at least one graphical representation of the predicted drilling mechanics 204 are color coded.

Header description

The following is a listing of the various symbols, corresponding brief descriptions, units, and data ranges with respect to the various columns of information illustrated in FIG. 4. Note that this listing is exemplary only, and not intended to be limiting. It is included herein for providing a thorough understanding of the illustration of FIG. 4. Other symbols, descriptions, units, and data ranges are possible.

| Header Symbol | Description | Units | Data Range |
|---|---|---|---|
| Log Data Column (208): | | | |
| GR (API) | Gamma Ray Log | API | 0–150 |
| RHOB (g/cc) | Bulk Density Log | g/cc | 2–3 |
| DT (μs/ft) | Acoustic or Sonic Log | microsec/ft | 40–140 |
| CAL (in) | Caliper Log | in | 6–16 |
| Depth Column (206): | | | |
| MD (ft) | Measured Depth | ft (or meters) | 200–1700 |
| Lithology Column (210): | | | |
| SS | Sandstone concentration | % | 0–100 |
| LS | Limestone concentration | % | 0–100 |
| DOL | Dolomite concentration | % | 0–100 |
| COAL | Coal concentration | % | 0–100 |
| SH | Shale concentration | % | 0–100 |
| Porosity Column (212): | | | |
| ND-POR | Neutron-Density Porosity | % (fractional) | 0–1 |
| N-POR | Neutron Porosity | % (fractional) | 0–1 |
| D-POR | Density Porosity | % (fractional) | 0–1 |
| S-POR | Sonic Porosity | % (fractional) | 0–1 |
| Rock Strength Column (216): | | | |
| CCS (psi) | Confined Rock Strength | psi | 0–50,000 |
| UCS (psi) | Unconfined Rock Strength | psi | 0–50,000 |
| CORE (psi) | Measured Core Strength | psi | 0–50,000 |
| Rock Strength Column (218): | | | |
| ROCK CCS | Confined Rock Strength | psi | 0–50,000 |
| Shale Plasticity Column (230): | | | |
| PLASTICITY | Shale Plasticity | % (fractional) | 0–1 |
| CEC-N | Normalized Cation Exchange Capacity | % (fractional) | 0–1 |
| CBW-N | Normalized Clay Bound Water | % (fractional) | 0–1 |
| Vsh-N | Normalized Shale Volume | % (fractional) | 0–1 |
| Shale Plasticity Column (232): | | | |
| PLASTICITY | Shale Plasticity | % | 0–100 |
| Bit Wear Column (236): | | | |
| ABRASW (t · mi) | Formation Abrasivity | ton · miles | 0–10,000 |
| WORK (t · mi) | Cumulative Work | ton · miles | 0–10,000 |
| SP ENERGY (ksi) | Specific Energy | ksi (1,000 psi) | 0–1,000 |
| Bit Wear Column (238): | | | |
| Red[1] | Expended Bit Life | % | 0–100 |
| Green[1] | Remaining Bit Life | % | 0–100 |
| Mechanical Efficiency Column (246): | | | |
| TOB-CUT (ft · lb) | Cutting torque on bit | ft · lb | 0–4,000 |
| TOB (ft · lb) | Total torque on bit | ft · lb | 0–4,000 |
| Mechanical Efficiency Column (248): | | | |
| Cyan[1] | Cutting Torque | % | 0–100 |
| Yellow[1] | Frictional Torque - Unconstrained | % | 0–100 |
| Red[1] | Frictional Torque - Constrained | % | 0–100 |

-continued

| Header Symbol | Description | Units | Data Range |
|---|---|---|---|
| Mechanical Efficiency Constraints Column (256): | | | |
| Cyan[1] | Maximum TOB Constraint | % | 0–100 |
| Red[1] | Maximum WOB Constraint | % | 0–100 |
| Yellow[1] | Minimum RPM Constraint | % | 0–100 |
| Green[1] | Maximum ROP Constraint | % | 0–100 |
| Blue[1] | Unconstrained | % | 0–100 |
| Power Column (260): | | | |
| POB-LIM (hp) | Power Limit | hp | 0–100 |
| POB (hp) | Operating Power Level | hp | 0–100 |
| Power Constraints Column (262): | | | |
| Cyan[1] | Maximum RPM Constraint | % | 0–100 |
| Red[1] | Maximum ROP Constraint | % | 0–100 |
| Blue[1] | Unconstrained | % | 0–100 |
| Operating Parameters Columns (266): | | | |
| RPM | Rotary RPM | rpm | 50–150 |
| WOB (lb) | Weight-on-bit | lb | 0–50,000 |
| COST ($/ft) | Drilling cost per foot | $/ft | 0–100 |
| ROP (ft/hr) | Instantaneous penetration rate | ft/hr | 0–200 |
| ROP-AVG (ft/hr) | Average penetration rate | ft/hr | 0–200 |

Note [1]The color indicated is represented by a respective shading, further as illustrated on FIG. 4 for the respective column.

Depth, log data, lithology, porosity

As shown in FIG. 4, the depth of formation 206 is expressed in the form of a numeric representation. Log data 208 is expressed in the form of a curve representation, the log data 208 including any log suite sensitive to lithology and porosity. Lithology 210 is expressed in the form of a percentage graph for use in identifying different types of rock within the given formation, the percentage graph illustrating a percentage of each type of rock at a given depth as determined from any log suite sensitive to lithology. In one embodiment, the lithology percentage graph is color coded. Porosity 212 is expressed in the form of a curve representation, the porosity being determined from any log suite sensitive to porosity.

Rock strength

On display 200 of FIG. 4, rock strength 214 is expressed in the form of at least one of the following representations selected from the group consisting of a curve representation 216, a percentage graph representation (not illustrated, but similar to 210), and a band representation 218. The curve representation 216 of rock strength includes confined rock strength 220 and unconfined rock strength 222. An area 224 between respective curves of confined rock strength 220 and unconfined rock strength 222 is graphically illustrated and represents an increase in rock strength as a result of a confining stress. The band representation 218 of rock strength provides a graphical illustration indicative of a discrete range of rock strength at a given depth, and more generally, to various discrete ranges of rock strength along the given well bore. In a preferred embodiment, the band representation 218 of the rock strength is color coded, including a first color representative of a soft rock strength range, a second color representative of a hard rock strength range, and additional colors representative of one or more intermediate rock strength ranges. Still further, the color blue can be used to be indicative of the soft rock strength range, red to be indicative of the hard rock strength range, and yellow to be indicative of an intermediate rock strength range. A legend 226 is provided on the display for assisting in an interpretation of the various displayed geology characteristics and predicted drilling mechanics.

Shale plasticity

On display 200 of FIG. 4, shale plasticity 228 is expressed in the form of at least one of the following representations selected from the group consisting of a curve representation 230, a percentage graph representation (not illustrated, but similar to 210), and a band representation 232. The curve representation 230 of shale plasticity 228 includes at least two curves of shale plasticity parameters selected from the group consisting of water content, clay type, and clay volume, further wherein shale plasticity is determined from water content, clay type, and clay volume according to a prescribed shale plasticity model 150 (FIG. 3). In addition, the representations of shale plasticity are preferably color coded. The band representation 232 of the shale plasticity 228 provides a graphical illustration indicative of a discrete range of shale plasticity at a given depth, and more generally, to various discrete ranges of shale plasticity along the given well bore. In a preferred embodiment, the band representation 232 of the shale plasticity 228 is color coded, including a first color representative of a low shale plasticity range, a second color representative of a high shale plasticity range, and additional colors representative of one or more intermediate shale plasticity ranges. Still further, the color blue can be used to be indicative of the low shale plasticity range, red to be indicative of the high shale plasticity range, and yellow to be indicative of an intermediate shale plasticity range. As mentioned above, legend 226 on the display 200 provides for assisting in an interpretation of the various displayed geology characteristics and predicted drilling mechanics.

Bit work/wear relationship

Bit wear 234 is determined as a function of cumulative work done according to a prescribed bit wear model 156 (FIG. 3). On display 200 of FIG. 4, bit wear 234 is expressed in the form of at least one of the following representations selected from the group consisting of a curve representation 236 and a percentage graph representation 238. The curve representation 236 of it wear may include bit work expressed as specific energy level at the bit, cumulative work done by the bit, and optional work losses due to abrasivity. With respect to the percentage graph representation, bit wear 234 can be expressed as a graphically illustrated percentage graph 238 indicative of a bit wear condition at a given depth. In a preferred embodiment, the graphically illustrated percentage graph 238 of bit wear is color coded, including a first color 240 representative of expired bit life, and a second color 242 representative of remaining bit life. Furthermore, the first color is preferably red and the second color is preferably green.

Mechanical efficiency

Bit mechanical efficiency is determined as a function of a torque/weight-on-bit signature for the given bit according to a prescribed mechanical efficiency model 152 (FIG. 3). On display 200 of FIG. 4, bit mechanical efficiency 244 is expressed in the form of at least one of the following representations selected from the group consisting of a curve representation 246 and a percentage graph representation 248. The curve representation 246 of bit mechanical efficiency includes total torque (TOB(ft·lb)) and cutting torque (TOB-CUT(ft·lb)) at the bit. The percentage graph representation 248 of bit mechanical efficiency 244 graphically illustrates total torque, wherein total torque includes cutting torque and frictional torque components. In a preferred embodiment, the graphically illustrated percentage graph 248 of mechanical efficiency is color coded, including a first color for illustrating cutting torque 250, a second color for illustrating frictional unconstrained torque 252, and a third color for illustrating frictional constrained torque 254. Legend 226 also provides for assisting in an interpretation of the various torque components of mechanical efficiency. Still further, the first color is preferably blue, the second color is preferably yellow, and the third color is preferably red.

In addition to the curve representation 246 and the percentage graph 248, mechanical efficiency 244 is further represented in the form of a percentage graph 256 illustrating drilling system operating constraints which have an adverse impact upon mechanical efficiency. The drilling system operating constraints correspond to constraints which result in an occurrence of frictional constrained torque (for instance, as illustrated by reference numeral 254 in percentage graph 248), the percentage graph 256 further for indicating a corresponding percentage of impact that each constraint has upon the frictional constrained torque component of the mechanical efficiency at a given depth. The drilling system operating constraints can include maximum torque-on-bit (TOB), maximum weight-on-bit (WOB), minimum revolution-per-minute (RPM), maximum penetration rate (ROP), in any combination, and an unconstrained condition. In a preferred embodiment, the percentage graph representation 256 of drilling system operating constraints on mechanical efficiency is color coded, including different colors for identifying different constraints. Legend 226 further provides assistance in an interpretation of the various drilling system operating constraints on mechanical efficiency with respect to percentage graph representation 256.

Power

On display 200 of FIG. 4, power 258 is expressed in the form of at least one of the following representations selected from the group consisting of a curve representation 260 and a percentage graph representation 262. The curve representation 260 for power 258 includes power limit (POB-LIM (hp)) and operating power level (POB(hp)). The power limit (POB-LIM(hp)) corresponds to a maximum power to be applied to the bit. The operating power level (POB(hp)) includes at least one of the following selected from the group consisting of constrained operating power level, recommended operating power level, and predicted operating power level. With respect to the curve representation 260, a difference between the power limit (POB-LIM(hp)) and operating power level (POB(hp)) curves is indicative of a constraint.

Power 258 is further represented in the form of a percentage graph representation 262 illustrating drilling system operating constraints which have an adverse impact upon power. The drilling system operating constraints correspond to those constraints which result in a power loss. The power constraint percentage graph 262 is further for indicating a corresponding percentage of impact that each constraint has upon the power at a given depth. In a preferred embodiment, the percentage graph representation 262 of drilling system operating constraint on power is color coded, including different colors for identifying different constraints. Furthermore, red is preferably used to identify a maximum ROP, blue is preferably used to identify a maximum RPM, and dark blue is preferably used to identify an unconstrained condition. Legend 226 further provides assistance in an interpretation of the various drilling system operating constraints on power with respect to percentage graph representation 262.

Operating parameters

As shown in FIG. 4, operating parameters 264 are expressed in the form of a curve representation 266. As discussed above, the operating parameters may include at least one of the following selected from the group consisting of weight-on-bit, rotary rpm (revolutions-per-minute), cost, rate of penetration, and torque. Additionally, rate of penetration includes instantaneous rate of penetration (ROP) and average rate of penetration (ROP-AVG).

Bit selection/recommendation

Display 200 further provides a means for generating a display 268 of details of proposed or recommended drilling equipment. That is, details of the proposed or recommended drilling equipment are displayed along with the geology characteristic 202 and predicted drilling mechanics 204 on display 200. The proposed or recommended drilling equipment preferably include at least one bit selection used in predicting the performance of the drilling system. In addition, first and second bit selections, indicated by reference numerals 270 and 272, respectively, are recommended for use in a predicted performance of the drilling of the well bore. The first and second bit selections are identified with respective first and second identifiers, 276 and 278, respectively. The first and second identifiers, 276 and 278, respectively, are also displayed with the geology characteristic 202 and predicted drilling mechanics 204, further wherein the positioning of the first and second identifiers on the display 200 is selected to correspond with portions of the predicted performance to which the first and second bit selections apply, respectively. Still further, the display can include an illustration of each recommended bit selection and corresponding bit specifications.

Dashed line

With reference still to FIG. 4, display 200 further includes a bit selection change indicator 280. Bit selection change indicator 280 is provided for indicating that a change in bit selection from a first recommended bit selection 270 to a second recommended bit selection 272 is required at a given depth. The bit selection change indicator 280 is preferably displayed on the display 200 along with the geology characteristics 202 and predicted drilling mechanics 204.

The method and apparatus of the present disclosure thus advantageously enables an optimization of a drilling system and its use in a drilling program to be obtained early in the drilling program. The present method and apparatus further facilitate the making of appropriate improvements early in the drilling program. Any economic benefits resulting from the improvements made early in the drilling program are advantageously multiplied by the number of wells remaining to be drilled in the drilling program Significant and substantial savings for a company commissioning the drilling program can be advantageously achieved. Still further, the present method and apparatus provide for the making of measurements during drilling of each well bore, all the way through a drilling program, for the purpose of verifying that the particular drilling system equipment is being used optimally. Still further, drilling system equipment performance can be monitored more readily with the method and apparatus of the present disclosure, in addition to identifying potential adverse conditions prior to their actual occurrence.

Still further, with use of the present method and apparatus, the time required for obtaining of a successful drilling operation in which a given oil producing well of a plurality of wells is brought on-line is advantageously reduced. The method and apparatus of the present disclosure thus provide an increased efficiency of operation. Furthermore, the use of the present method and apparatus is particularly advantageous for a development project, for example, of establishing on the order of one hundred wells over a three year period in a given geographic location. With the present method and apparatus, a given well may be completed and be brought on-line, i.e., to marketable production, on the order of 30 days, for example, versus 60 days (or more) with the use of prior methods. With the improved efficiency of the drilling performance of a drilling system according to the present disclosure, a gain in time with respect to oil production is possible, which further translates into millions of dollars of oil product being available at an earlier date for marketing. Alternatively, for a given period of time, with the use of the present method and apparatus, one or more additional wells may be completed above and beyond the number of wells which would be completed using prior methods in the same period of time. In other words, drilling a new well in a lesser amount of time advantageously translates into marketable production at an earlier date.

The present embodiments advantageously provide for an evaluation of various proposed drilling equipment prior to and during an actual drilling of a well bore in a given formation, further for use with respect to a drilling program. Drilling equipment, its selection and use, can be optimized for a specific interval or intervals of a well bore (or interval) in a given formation. The drilling mechanics models advantageously take into account the effects of progressive bit wear through changing lithology. Recommended operating parameters reflect the wear condition of the bit in the specific lithology and also takes into account the operating constraints of the particular drilling rig being used. A printout or display of the geology characteristic and predicted drilling mechanics per unit depth for a given formation provides key information which is highly useful for a drilling operator, particularly for use in optimizing the drilling process of a drilling program. The printout or display further advantageously provides a heads up view of expected drilling conditions and recommended operating parameters.

A principal advantage of the present embodiments is that a large volume of complex and critical information is communicated clearly in a graphical format, such as illustrated and discussed herein with reference to FIG. 4. In addition, the use of color in the graphical format further accents key information. Still further, the display 200 advantageously provides a driller's road map. For example, with the display as a guide, the driller can be assisted with a decision of when to pull a given bit. The display further provides information regarding effects of operating constraints on performance and drilling mechanics. Still further, the display assists in selecting recommended operating parameters. With the use of the display, more efficient and safe drilling can be obtained. Most advantageously, important information is communicated clearly.

While the invention has been particularly shown and described with reference to the preferred embodiment thereof, it will be understood by those skilled in the art that various changes in form and detail may be made therein without departing form the spirit and scope of the invention, as set forth in the following claims.

What is claimed is:

1. An apparatus for predicting the performance of a drilling system for the drilling of a well bore in a given formation, said prediction apparatus comprising:

means for generating a geology characteristic of the formation per unit depth according to a prescribed geology model and outputting signals representative of the geology characteristic, the geology characteristic including at least rock strength;

means for inputting specifications of proposed drilling equipment for use in the drilling of the well bore, the specifications including at least a bit specification of a recommended drill bit; and means for determining a predicted drilling mechanics in response to the specifications of the proposed drilling equipment as a function of the geology characteristic per unit depth according to a prescribed drilling mechanics model and outputting signals representative of the predicted drilling mechanics, the predicted drilling mechanics including at least one of the following selected from the group consisting of bit wear, mechanical efficiency, power, and operating parameters.

2. The apparatus of claim 1, further comprising:

means responsive to the geology characteristic output signals and the predicted drilling mechanics output signals for generating a display of the geology characteristic and predicted drilling mechanics per unit depth.

3. The apparatus of claim 2, wherein said display generating means includes a display monitor.

4. The apparatus of claim 2, wherein said display generating means includes a printer, further wherein the display of the geology characteristic and predicted drilling mechanics per unit depth includes a printout.

5. The apparatus of claim 1, wherein said geology characteristic generating means further generates at least one of the following additional characteristics selected from the group consisting of log data, lithology, porosity, and shale plasticity.

6. The apparatus of claim 1, wherein said proposed drilling equipment input specification means further includes inputting at least one additional specification of proposed drilling equipment selected from the group consisting of down hole motor, top drive motor, rotary table motor, mud system, and mud pump.

7. The apparatus of claim 1, wherein the operating parameters include at least one of the following selected from the group consisting of weight-on-bit, rotary rpm (revolutions-per-minute), cost, rate of penetration, and torque.

8. The apparatus of claim 7, further wherein rate of penetration includes instantaneous rate of penetration (ROP) and average rate of penetration (ROP-AVG).

9. The apparatus of claim 1, wherein said geology characteristic generating means further generates at least one of the following additional characteristics selected from the group consisting of log data, lithology, porosity, and shale plasticity, said proposed drilling equipment input specification means further includes inputting at least one additional specification of proposed drilling equipment selected from the group consisting of down hole motor, top drive motor, rotary table motor, mud system, and mud pump, and the operating parameters include at least one of the following selected from the group consisting of weight-on-bit, rotary rpm (revolutions-per-minute), cost, rate of penetration, and torque, said apparatus further comprising:

means responsive to the geology characteristic output signals and the predicted drilling mechanics output signals for generating a display of the geology characteristic and predicted drilling mechanics per unit depth.

10. The apparatus of claim 9, wherein said display generating means includes a display monitor.

11. The apparatus of claim 9, wherein said display generating means includes a printer, further wherein the display of the geology characteristic and predicted drilling mechanics per unit depth includes a printout.

12. The apparatus of claim 1, further comprising:

means responsive to a predicted drilling mechanics output signal for controlling a parameter in an actual drilling of the well bore with the drilling system, the parameter including at least one selected from the group consisting of weight-on-bit, rpm, pump flow rate, and hydraulics.

13. The apparatus of claim 2, wherein the display of the geology characteristic includes at least one graphical representation selected from the group consisting of a curve representation, a percentage graph representation, and a band representation, and the display of the predicted drilling mechanics includes at least one graphical representation selected from the group consisting of a curve representation, a percentage graph representation, and a band representation.

14. The apparatus of claim 13, further wherein the at least one graphical representation of the geology characteristic and the at least one graphical representation of the predicted drilling mechanics are color coded.

15. The apparatus of claim 13, wherein said display generating means includes a display monitor.

16. The apparatus of claim 13, wherein said display generating means includes a printer, further wherein the display of the geology characteristic and predicted drilling mechanics per unit depth includes a printout.

17. The apparatus of claim 13, wherein said geology characteristic generating means further generates at least one of the following additional characteristics selected from the group consisting of log data, lithology, porosity, and shale plasticity, and the operating parameters include at least one of the following selected from the group consisting of weight-on-bit, rotary rpm (revolutions-per-minute), cost, rate of penetration, and torque.

18. The apparatus of claim 17, further wherein rate of penetration includes instantaneous rate of penetration (ROP) and average rate of penetration (ROP-AVG).

19. The apparatus of claim 17, wherein log data is expressed in the form of a curve representation, the log data including any log suite sensitive to lithology and porosity, lithology is expressed in the form of a percentage graph for use in identifying different types of rock within the given formation, the percentage graph illustrating a percentage of each type of rock at a given depth as determined from any log suite sensitive to lithology, and porosity is expressed in the form of a curve representation, the porosity being determined from any log suite sensitive to porosity.

20. The apparatus of claim 19, wherein the lithology percentage graph is color coded.

21. The apparatus of claim 13, wherein rock strength is expressed in the form of at least one of the following representations selected from the group consisting of a curve representation, a percentage graph representation, and a band representation.

22. The apparatus of claim 21, further wherein the curve representation of rock strength includes confined rock strength and unconfined rock strength, further wherein an area between respective curves of confined rock strength and unconfined rock strength is graphically illustrated and represents an increase in rock strength as a result of a confining stress.

23. The apparatus of claim 21, further wherein the band representation of rock strength provides a graphical illustration indicative of a discrete range of rock strength at a given depth.

24. The apparatus of claim 23, further wherein the band representation of the rock strength is color coded, including a first color representative of a soft rock strength range, a second color representative of a hard rock strength range, and additional colors representative of one or more intermediate rock strength ranges.

25. The apparatus of claim 24, still further wherein blue is indicative of the soft rock strength range, red is indicative of the hard rock strength range, and yellow is indicative of an intermediate rock strength range.

26. The apparatus of claim 17, wherein shale plasticity is expressed in the form of at least one of the following representations selected from the group consisting of a curve representation, a percentage graph representation, and a band representation.

27. The apparatus of claim 26, wherein the curve representation of shale plasticity includes at least two curves of shale plasticity parameters selected from the group consisting of water content, clay type, and clay volume, further wherein shale plasticity is determined from water content, clay type, and clay volume according to a prescribed shale plasticity model.

28. The apparatus of claim 26, wherein the curve representation of shale plasticity is color coded.

29. The apparatus of claim 26, wherein the band representation of the shale plasticity provides a graphical illustration indicative of a discrete range of shale plasticity at a given depth.

30. The apparatus of claim 29, further wherein the band representation of the shale plasticity is color coded, including a first color representative of a low shale plasticity range, a second color representative of a high shale plasticity range, and additional colors representative of one or more intermediate shale plasticity ranges.

31. The apparatus of claim 30, still further wherein blue is indicative of the low shale plasticity range, red is indicative of the high shale plasticity range, and yellow is indicative of an intermediate shale plasticity range.

32. The apparatus of claim 13, wherein bit wear is determined as a function of cumulative work done according to a prescribed bit wear model.

33. The apparatus of claim 32, wherein bit wear is expressed in the form of at least one of the following representations selected from the group consisting of a curve representation and a percentage graph representation.

34. The apparatus of claim 33, wherein the curve representation of bit wear may include bit work expressed as specific energy level at the bit, cumulative work done by the bit, and optional work losses due to abrasivity.

35. The apparatus of claim 32, wherein bit wear is expressed as a graphically illustrated percentage graph indicative of a bit wear condition at a given depth.

36. The apparatus of claim 35, further wherein the graphically illustrated percentage graph of bit wear is color coded, including a first color representative of expired bit life, and a second color representative of remaining bit life.

37. The apparatus of claim 36, still further wherein the first color is red and the second color is green.

38. The apparatus of claim 13, wherein bit mechanical efficiency is determined as a function of a torque/weight-on-bit signature for the given bit according to a prescribed mechanical efficiency model.

39. The apparatus of claim 38, wherein wherein bit mechanical efficiency is expressed in the form of at least one of the following representations selected from the group consisting of a curve representation and a percentage graph representation.

40. The apparatus of claim 39, wherein the curve representation of bit mechanical efficiency includes total torque and cutting torque at the bit.

41. The apparatus of claim 39, wherein the percentage graph representation of bit mechanical efficiency graphically illustrates total torque, total torque including cutting torque and frictional torque components.

42. The apparatus of claim 41, further wherein the graphically illustrated percentage graph representation of bit mechanical efficiency is color coded, including a first color for illustrating cutting torque, a second color for illustrating frictional unconstrained torque, and a third color for illustrating frictional constrained torque.

43. The apparatus of claim 42, still further wherein the first color is blue, the second color is yellow, and the third color is red.

44. The apparatus of claim 38, wherein mechanical efficiency is further represented in the form of a percentage graph illustrating drilling system operating constraints which have an adverse impact upon mechanical efficiency, the drilling system operating constraints corresponding to constraints which result in an occurrence of frictional constrained torque, the percentage graph further for indicating a corresponding percentage of impact that each constraint has upon the frictional constrained torque component of the mechanical efficiency at a given depth.

45. The apparatus of claim 44, further wherein the drilling system operating constraints can include maximum torque-on-bit (TOB), maximum weight-on-bit (WOB), minimum revolution-per-minute (RPM), maximum penetration rate (ROP), in any combination, and an unconstrained condition.

46. The apparatus of claim 45, further wherein the percentage graph representation of drilling system operating constraints on mechanical efficiency is color coded, including different colors for identifying different constraints.

47. The apparatus of claim 13, wherein power is expressed in the form of at least one of the following representations selected from the group consisting of a curve representation and a percentage graph representation.

48. The apparatus of claim 47, wherein the curve representation for power includes power limit and operating power level, the power limit corresponding to a maximum power to be applied to the bit and the operating power level including at least one of the following selected from the group consisting of constrained operating power level, recommended operating power level, and predicted operating power level.

49. The apparatus of claim 48, further wherein a difference between the power limit and operating power level curves is indicative of a constraint.

50. The apparatus of claim 47, wherein power is further represented in the form of a percentage graph representation illustrating drilling system operating constraints which have an adverse impact upon power, the drilling system operating constraints corresponding to those constraints which result in a power loss, the power constraint percentage graph further for indicating a corresponding percentage of impact that each constraint has upon the power at a given depth.

51. The apparatus of claim 50, wherein the percentage graph representation of drilling system operating constraints on power is color coded, including different colors for identifying different constraints.

52. The apparatus of claim 51, further wherein red is used to identify a maximum ROP, blue is used to identify a maximum RPM, and dark blue is used to identify an unconstrained condition.

53. The apparatus of claim 13, wherein operating parameters are expressed in the form of a curve representation.

54. The apparatus of claim 2, further comprising:

means for generating a display of details of proposed drilling equipment, the details of proposed drilling equipment to be displayed along with the geology characteristic and predicted drilling mechanics, the proposed drilling equipment including at least one recommended bit selection used in predicting the performance of the drilling system.

55. The apparatus of claim 54, wherein the proposed drilling equipment further includes at least one additional proposed drilling equipment selected from the group consisting of down hole motor, top drive motor, rotary table motor, mud system, and mud pump.

56. The apparatus of claim 54, wherein first and second bit selections are recommended for use in a predicted performance of the drilling of the well bore, further wherein the first and second bit selections are identified with respective first and second identifiers, the first and second identifiers being displayed with the geology characteristic and predicted drilling mechanics, further wherein the positioning of the first and second identifiers on the display is selected to correspond with portions of the predicted performance to which the first and second bit selections apply, respectively.

57. The apparatus of claim 56, wherein the display further includes an illustration of each recommended bit selection and corresponding bit specifications.

58. The apparatus of claim 2, further comprising:

a bit selection change indicator for indicating that a change in bit selection from a first recommended bit selection to a second recommended bit selection is required at a given depth, said bit selection change indicator for being displayed on the display of geology characteristics and predicted drilling mechanics.

59. A method for predicting the performance of a drilling system for the drilling of a well bore in a given formation, said prediction method comprising the steps of:

generating a geology characteristic of the formation per unit depth according to a prescribed geology model and outputting signals representative of the geology characteristic, the geology characteristic including at least rock strength;

obtaining specifications of proposed drilling equipment for use in the drilling of the well bore, the specifications including at least a bit specification of a recommended drill bit; and determining a predicted drilling mechanics in response to the specifications of the proposed drilling equipment as a function of the geology characteristic per unit depth according to a prescribed drilling mechanics model and outputting signals representative of the predicted drilling mechanics, the predicted drilling mechanics including at least one of the following selected from the group consisting of bit wear, mechanical efficiency, power, and operating parameters.

60. The method of claim 59, further comprising the step of:

generating a display of the geology characteristic and predicted drilling mechanics per unit depth in response to the geology characteristic output signals and the predicted drilling mechanics output signals.

61. The method of claim 60, wherein generating a display includes using a display monitor.

62. The method of claim 60, wherein generating a display includes using a printer for providing a printout of the geology characteristic and predicted drilling mechanics per unit depth.

63. The method of claim 59, wherein generating the geology characteristic further includes generating at least one of the following additional characteristics selected from the group consisting of log data, lithology, porosity, and shale plasticity.

64. The method of claim 59, wherein obtaining proposed drilling equipment specifications further includes obtaining at least one additional specification of proposed drilling equipment selected from the group consisting of down hole motor, top drive motor, rotary table motor, mud system, and mud pump.

65. The method of claim 59, wherein the operating parameters include at least one of the following selected from the group consisting of weight-on-bit, rotary rpm (revolutions-per-minute), cost, rate of penetration, and torque.

66. The method of claim 65, further wherein rate of penetration includes instantaneous rate of penetration (ROP) and average rate of penetration (ROP-AVG).

67. The method of claim 59, further comprising the step of controlling a parameter in an actual drilling of the well bore with the drilling system in response to a predicted drilling mechanics output signal, the parameter including at least one selected from the group consisting of weight-on-bit, rpm, pump flow rate, and hydraulics.

68. The method of claim 60, wherein displaying of the geology characteristic includes displaying at least one graphical plot selected from the group consisting of a curve representation, a percentage graph representation, and a band representation, and displaying of the predicted drilling mechanics includes displaying at least one graphical plot selected from the group consisting of a curve representation, a percentage graph representation, and a band representation.

69. The method of claim 68, further wherein the at least one graphical plot of the geology characteristic and the at least one graphical plot of the predicted drilling mechanics are color coded.

70. The method of claim 68, wherein displaying includes using a display monitor.

71. The method of claim 68, wherein displaying includes using a printer for providing a printout of the geology characteristic and predicted drilling mechanics per unit depth.

72. The method of claim 68, wherein generating the geology characteristic further includes generating at least one of the following additional characteristics selected from the group consisting of log data, lithology, porosity, and shale plasticity, and the operating parameters include at least one of the following selected from the group consisting of weight-on-bit, rotary rpm (revolutions-per-minute), cost, rate of penetration, and torque.

73. The method of claim 72, further wherein rate of penetration includes instantaneous rate of penetration (ROP) and average rate of penetration (ROP-AVG).

74. A method for drilling a series of well bores in a given formation for a given drilling program with the use of a given drilling system and an apparatus for predicting the performance of the drilling system, the prediction apparatus having a prescribed set of geology and drilling mechanics models and further having optimization, prediction, and calibration modes of operation, the prediction apparatus further comprising a means for generating a geology characteristic of the formation per unit depth according to the prescribed geology model and outputting signals representative of the geology characteristic, the geology characteristic including at least rock strength, a means for inputting specifications of proposed drilling equipment for use in the drilling of a well bore, the specifications including at least a bit specification of a recommended drill bit, and a means for determining a predicted drilling mechanics in response to the specifications of the proposed drilling equipment as a function of the geology characteristic per unit depth according to the prescribed drilling mechanics model and outputting signals representative of the predicted drilling mechanics, the predicted drilling mechanics including at least one of the following selected from the group consisting of bit wear, mechanical efficiency, power, and operating parameters, said method comprising the steps of:

(a) generating a predicted drilling performance for drilling of a given well bore in accordance with the prescribed set of geology and drilling mechanics prediction models using at least one of the following modes selected from the group consisting of the optimization mode and the prediction mode, the predicted drilling performance including predicted drilling mechanics measurements;

(b) deciding whether or not to obtain actual drilling mechanics measurements during the drilling of the given well bore;

(c) if obtaining actual drilling mechanics measurements, then drilling the given well bore with the drilling system using the predicted drilling performance as a guide and obtaining actual drilling mechanics measurements;

(c-1) comparing the actual drilling mechanics measurements to the predicted drilling mechanics measurements using the calibration mode;

(c-2) if the comparison of the actual drilling mechanics measurements to the predicted drilling mechanics measurements are acceptable, then advancing to step (e); and (c-3) if the comparison of the actual drilling mechanics measurements to the predicted drilling mechanics measurements are not acceptable, then fine tuning at least one of the geology and drilling mechanics models using the calibration mode and advancing to step (e);

(d) if not obtaining actual drilling mechanics measurements, then drilling the given well bore with the drilling system using the predicted drilling performance as a guide and without obtaining actual drilling mechanics measurements; and (e) determining if any further well bores of the series of well bores remain to be drilled and if yes, then returning to step (a) with respect to the drilling of a subsequent well bore in the series of well bores, and if no, then ending the drilling of the series of well bores.

75. A computer program stored on a computer-readable medium for execution by a computer for predicting the performance of a drilling system in the drilling of a well bore of a given formation, said computer program comprising:

instructions for generating a geology characteristic of the formation per unit depth according to a prescribed geology model and outputting signals representative of the geology characteristic, the geology characteristic including at least rock strength;

instructions for obtaining specifications of proposed drilling equipment for use in the drilling of the well bore, the specifications including at least a bit specification of a recommended drill bit; and instructions for determining a predicted drilling mechanics in response to the specifications of the proposed drilling equipment as a function of the geology characteristic per unit depth according to a prescribed drilling mechanics model and outputting signals representative of the predicted drilling mechanics, the predicted drilling mechanics including at least one of the following selected from the group consisting of bit wear, mechanical efficiency, power, and operating parameters.

76. The computer program of claim 75, further comprising:

instructions for generating a display of the geology characteristic and predicted drilling mechanics per unit depth in response to the geology characteristic output signals and the predicted drilling mechanics output signals.

77. The computer program of claim 76, wherein generating a display includes using a display monitor.

78. The computer program of claim 76, wherein generating a display includes using a printer for providing a printout of the geology characteristic and predicted drilling mechanics per unit depth.

79. The computer program of claim 75, wherein generating the geology characteristic further includes generating at least one of the following additional characteristics selected from the group consisting of log data, lithology, porosity, and shale plasticity.

80. The computer program of claim 75, wherein obtaining proposed drilling equipment specifications further includes obtaining at least one additional specification of proposed drilling equipment selected from the group consisting of down hole motor, top drive motor, rotary table motor, mud system, and mud pump.

81. The computer program of claim 75, wherein the operating parameters include at least one of the following selected from the group consisting of weight-on-bit, rotary rpm (revolutions-per-minute), cost, rate of penetration, and torque.

82. The computer program of claim 81, further wherein rate of penetration includes instantaneous rate of penetration (ROP) and average rate of penetration (ROP-AVG).

83. The computer program of claim 75, further comprising instructions for controlling a parameter in an actual drilling of the well bore with the drilling system in response to a predicted drilling mechanics output signal, the parameter including at least one selected from the group consisting of weight-on-bit, rpm, pump flow rate, and hydraulics.

84. The computer program of claim 76, wherein displaying of the geology characteristic includes displaying at least one graphical plot selected from the group consisting of a curve representation, a percentage graph representation, and a band representation, and displaying of the predicted drilling mechanics includes displaying at least one graphical plot selected from the group consisting of a curve representation, a percentage graph representation, and a band representation.

85. The computer program of claim 84, further wherein the at least one graphical plot of the geology characteristic and the at least one graphical plot of the predicted drilling mechanics are color coded.

86. The computer program of claim 84, wherein displaying includes using a display monitor.

87. The computer program of claim 84, wherein displaying includes using a printer for providing a printout of the geology characteristic and predicted drilling mechanics per unit depth.

88. The computer program of claim 84, wherein generating the geology characteristic further includes generating at least one of the following additional characteristics selected from the group consisting of log data, lithology, porosity, and shale plasticity, and the operating parameters include at least one of the following selected from the group consisting of weight-on-bit, rotary rpm (revolutions-per-minute), cost, rate of penetration, and torque, further wherein rate of penetration includes instantaneous rate of penetration (ROP) and average rate of penetration (ROP-AVG).

89. A display of predicted performance of a drilling system suitable for use as guidance in the drilling of a well bore in a given formation, said display comprising:

a geology characteristic of the formation per unit depth, said geology characteristic having been obtained according to a prescribed geology model and including at least rock strength;

specifications of proposed drilling equipment for use in the drilling of the well bore, said specifications including at least a bit specification of a recommended drill bit; and a predicted drilling mechanics, said predicted drilling mechanics having been determined in response to said specifications of the proposed drilling equipment as a function of said geology characteristic per unit depth according to a prescribed drilling mechanics model, said predicted drilling mechanics including at least one of the following selected from the group consisting of bit wear, mechanical efficiency, power, and operating parameters.

90. The display of claim 89, wherein said display is disposed upon a display monitor.

91. The display of claim 89, wherein said display is disposed on a printout.

92. The display of claim 89, wherein said geology characteristic includes at least one graphical representation selected from the group consisting of a curve representation, a percentage graph representation, and a band representation, and said display of the predicted drilling mechanics includes at least one graphical representation selected from the group consisting of a curve representation, a percentage graph representation, and a band representation.

93. The display of claim 92, further wherein the at least one graphical representation of said geology characteristic and the at least one graphical representation of said predicted drilling mechanics are color coded.

94. The display of claim 92, wherein said geology characteristic further includes at least one of the following additional characteristics selected from the group consisting of log data, lithology, porosity, and shale plasticity, and the operating parameters include at least one of the following selected from the group consisting of weight-on-bit, rotary rpm (revolutions-per-minute), cost, rate of penetration, and torque.

95. The display of claim 94, further wherein rate of penetration includes instantaneous rate of penetration (ROP) and average rate of penetration (ROP-AVG).

96. The display of claim 94, wherein log data is expressed in the form of a curve representation, the log data including any log suite sensitive to lithology and porosity, lithology is expressed in the form of a percentage graph for use in identifying different types of rock within the given formation, the percentage graph illustrating a percentage of each type of rock at a given depth as determined from any log suite sensitive to lithology, porosity is expressed in the form of a curve representation, the porosity being determined from any log suite sensitive to porosity, rock strength is expressed in the form of at least one of the following representations selected from the group consisting of a curve representation, a percentage graph representation, and a band representation wherein the curve representation of rock strength includes confined rock strength and unconfined rock strength, further wherein an area between respective curves of confined rock strength and unconfined rock strength is graphically illustrated and represents an increase in rock strength as a result of a confining stress, further wherein the band representation of rock strength provides a graphical illustration indicative of a discrete range of rock strength at a given depth, shale plasticity is expressed in the form of at least one of the following representations selected from the group consisting of a curve representation, a percentage graph representation, and a band representation, wherein the curve representation of shale plasticity includes at least two curves of shale plasticity parameters selected from the group consisting of water content, clay type, and clay volume, further wherein shale plasticity is determined from water content, clay type, and clay volume according to a prescribed shale plasticity model, wherein the band representation of the shale plasticity provides a graphical illustration indicative of a discrete range of shale plasticity at a given depth.

97. The display of claim 96, still further wherein lithology is color coded, rock strength is color coded, the band representation including a first color representative of a soft rock strength range, a second color representative of a hard rock strength range, and additional colors representative of one or more intermediate rock strength ranges, further wherein blue is indicative of the soft rock strength range, red is indicative of the hard rock strength range, and yellow is indicative of an intermediate rock strength range, shale plasticity is color coded, the band representation of the shale plasticity including a first color representative of a low shale plasticity range, a second color representative of a high shale plasticity range, and additional colors representative of one or more intermediate shale plasticity ranges, further wherein blue is indicative of the low shale plasticity range, red is indicative of the high shale plasticity range, and yellow is indicative of an intermediate shale plasticity range.

98. The display of claim 94, wherein bit wear is determined as a function of cumulative work done according to a prescribed bit wear model, further wherein bit wear is expressed in the form of at least one of the following representations selected from the group consisting of a curve representation and a percentage graph representation, wherein the curve representation of bit wear may include bit work expressed as specific energy level at the bit, cumulative work done by the bit, and optional work losses due to abrasivity, and wherein the percentage graph representation of bit wear is indicative of a bit wear condition at a given depth, mechanical efficiency is determined as a function of a torque/weight-on-bit signature for the given bit according to a prescribed mechanical efficiency model, wherein mechanical efficiency is expressed in the form of at least one of the following representations selected from the group consisting of a curve representation and a percentage graph representation, wherein the curve representation of mechanical efficiency includes total torque and cutting torque at the bit, and the percentage graph representation of mechanical efficiency graphically illustrates total torque, total torque including cutting torque and frictional torque components, mechanical efficiency further being represented in the form of a percentage graph illustrating drilling system operating constraints which have an adverse impact upon mechanical efficiency, the drilling system operating constraints corresponding to constraints which result in an occurrence of frictional constrained torque, the percentage graph further for indicating a corresponding percentage of impact that each constraint has upon the frictional constrained torque component of the mechanical efficiency at a given depth, wherein the drilling system operating constraints can include maximum torque-on-bit (TOB), maximum weight-on-bit (WOB), minimum revolution-per-minute (RPM), maximum penetration rate (ROP), in any combination, and an unconstrained condition, power is expressed in the form of at least one of the following representations selected from the group consisting of a curve representation and a percentage graph representation, wherein the curve representation for power includes power limit and operating power level, the power limit corresponding to a maximum power to be applied to the bit and the operating power level including at least one of the following selected from the group consisting of constrained operating power level, recommended operating power level, and predicted operating power level, wherein a difference between the power limit and operating power level curves is indicative of a constraint, power is further represented in the form of a percentage graph representation illustrating drilling system operating constraints which have an adverse impact upon power, the drilling system operating constraints corresponding to those constraints which result in a power loss, the power constraint percentage graph further for indicating a corresponding percentage of impact that each constraint has upon the power at a given depth, operating parameters are expressed in the form of a curve representation.

99. The display of claim 98, further wherein the percentage graph representation of bit wear is color coded, including a first color representative of expired bit life, and a second color representative of remaining bit life, the first color including red and the second color including green, the percentage graph representation of mechanical efficiency is color coded, including a first color for illustrating cutting torque, a second color for illustrating frictional unconstrained torque, and a third color for illustrating frictional constrained torque, the first color including blue, the second color including yellow, and the third color including red, the percentage graph representation of drilling system operating constraints on mechanical efficiency is color coded, including different colors for identifying different constraints, the percentage graph representation of drilling system operating constraints on power is color coded, including different colors for identifying different constraints, wherein red is used to identify a maximum ROP, blue is used to identify a maximum RPM, and dark blue is used to identify an unconstrained condition.

100. The display of claim 89, further comprising:

details of proposed drilling equipment, said details of proposed drilling equipment to be displayed along with the geology characteristic and predicted drilling mechanics, the proposed drilling equipment including at least one recommended bit selection used in predicting the performance of the drilling system.

101. The display of claim 100, wherein first and second bit selections are recommended for use in a predicted performance of the drilling of the well bore, further wherein the first and second bit selections are identified with respective first and second identifiers, the first and second identifiers being displayed with the geology characteristic and predicted drilling mechanics, further wherein a positioning of the first and second identifiers on said display is selected to correspond with portions of the predicted performance to which the first and second bit selections apply, respectively.

102. The display of claim 101, further comprising:

a bit selection change indicator for indicating that a change in bit selection from a first recommended bit selection to a second recommended bit selection at a given depth is required, said bit selection change indicator being displayed on said display with said geology characteristics and predicted drilling mechanics.

* * * * *

UNITED STATES PATENT AND TRADEMARK OFFICE

CERTIFICATE OF CORRECTION

PATENT NO. : 6,109,368
DATED : August 29, 2000
INVENTOR(S) : Goldman et al.

It is certified that error appears in the above-identified patent and that said Letters Patent is hereby corrected as shown below:

Title page,
Item [75], Inventors, please delete "Oliver Mathews, III" and replace with -- Oliver Matthews, III --

Signed and Sealed this

Twenty-ninth Day of June, 2004

JON W. DUDAS
*Acting Director of the United States Patent and Trademark Office*